US010014600B1

(12) United States Patent
Mori et al.

(10) Patent No.: US 10,014,600 B1
(45) Date of Patent: Jul. 3, 2018

(54) TERMINAL CRIMPING STRUCTURE AND CONNECTOR WITH CABLE

(71) Applicant: Yazaki Corporation, Tokyo (JP)

(72) Inventors: Shigeo Mori, Shizuoka (JP); Hiroyuki Tanaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/810,193

(22) Filed: Nov. 13, 2017

(30) Foreign Application Priority Data

Dec. 20, 2016 (JP) ..... 2016-246474

(51) Int. Cl.

| | |
|---|---|
| ***H01R 9/05*** | (2006.01) |
| ***H01R 4/10*** | (2006.01) |
| ***H01R 13/6592*** | (2011.01) |
| ***H01R 24/38*** | (2011.01) |
| *H01R 103/00* | (2006.01) |

(52) U.S. Cl.
CPC ..... *H01R 9/0518* (2013.01); *H01R 13/6592* (2013.01); *H01R 24/38* (2013.01); *H01R 2103/00* (2013.01)

(58) Field of Classification Search
CPC ..... H01R 4/185; H01R 4/188; H01R 4/184; H01R 4/18; H01R 4/183; H01R 9/0518; H01R 2103/00; H01R 24/40; H01R 24/38
See application file for complete search history.

(56) References Cited

U.S. PATENT DOCUMENTS 8,519,267 B2 * 8/2013 Peters ..... H01R 4/203 174/122 C

FOREIGN PATENT DOCUMENTS

JP 2010-272404 A 12/2010

* cited by examiner

*Primary Examiner* — Xuong Chung Trans
(74) *Attorney, Agent, or Firm* — Kenealy Vaidya LLP

(57) ABSTRACT

A terminal crimping structure includes a coaxial cable, a terminal fitting including a tubular conductor connecting portion coaxially interposed between a terminal connecting portion of an outer conductor of the coaxial cable and an insulator, a tubular crimping member that allows the terminal connecting portion to be coaxially interposed between the crimping member and the conductor connecting portion to crimp the terminal connecting portion onto the conductor connecting portion, and a tubular member that is stronger and harder than the conductor connecting portion and coaxially interposed between the conductor connecting portion and the insulator. Linear conductors of the terminal connecting portion include crushed portions that abut each other. The crushed portions are crushed until they are axially extended by an amount achieving a target crushed state in which an oxide layer is broken to obtain an exposed region of a new surface required for adhesion to the conductor connecting portion.

6 Claims, 18 Drawing Sheets

TERMINAL CRIMPING STRUCTURE AND CONNECTOR WITH CABLE

CROSS-REFERENCE TO RELATED APPLICATION(S)

The present application claims priority to and incorporates by reference the entire contents of Japanese Patent Application No. 2016-246474 filed in Japan on Dec. 20, 2016.

BACKGROUND OF THE INVENTION

1. Field of the Invention

The present invention relates to a terminal crimping structure and a connector with a cable.

2. Description of the Related Art

A cable including, for example, a first wire connected to a positive electrode and a second wire connected to a negative electrode has been known. Such a two-core cable may require a large size. To prevent this situation, a coaxial cable that includes two coaxial conductors as the two cores which are coaxially arranged has been used (see Japanese Patent Application Laid-open No. 2010-272404, for example). Such a coaxial cable includes a pillar-shaped center conductor, a tubular outer conductor, and a tubular insulator coaxially interposed between the center conductor and the outer conductor. The outer conductor is composed of a plurality of linear conductors. These linear conductors are circumferentially arranged on an outer circumferential surface of the insulator and are configured to virtually form a tubular shape. In the coaxial cable, for example, a first terminal fitting is physically and electrically connected to the center conductor, and a second terminal fitting is physically and electrically connected to the outer conductor.

Here, the second terminal fitting includes a tubular conductor connecting portion to which an exposed terminal connecting portion of the outer conductor is physically and electrically connected. A tubular crimping member is coaxially disposed radially outside of the conductor connecting portion, and the terminal connecting portion of the outer conductor is interposed between the crimping member and the conductor connecting portion. Pressure is applied to the crimping member radially inward at a plurality of circumferential locations, and the crimping member is swaged and deformed, thereby crimping the linear conductors of the terminal connecting portion onto the conductor connecting portion. In this terminal crimping structure, the crimping member crushes the linear conductors of the terminal connecting portion when swaged and deformed, thereby increasing crimp strength between the conductor connecting portion and the linear conductors. However, the coaxial cable described above has flexibility so that it can be readily routed in various route paths. The insulator also receives force from the conductor connecting portion upon application of pressure, and thus cannot exert an equal reaction force on the conductor connecting portion. In this conventional terminal crimping structure, the conductor connecting portion may be deformed radially inward when the crimping member exerts force on the terminal connecting portion upon application of the pressure. With this configuration, it is difficult to increase crimping accuracy between the terminal connecting portion and the conductor connecting portion.

SUMMARY OF THE INVENTION

It is an object of the present invention to provide a terminal crimping structure and a connector with a cable that can increase crimping accuracy.

In order to achieve the above mentioned object, a terminal crimping structure according to one aspect of the present invention includes a coaxial cable that includes a pillar-shaped center conductor, a tubular insulator, and a tubular outer conductor coaxially disposed in this order from an axis, the outer conductor including a plurality of linear conductors made of aluminum or aluminum alloy, the linear conductors extending along an outer circumferential surface of the insulator in a direction that crosses a circumferential direction of the insulator to a cable axial direction, the linear conductors being arranged along the circumferential direction to virtually form the tubular outer conductor in a tubular shape, a terminal fitting that includes a terminal-to-terminal connecting portion that is physically and electrically connected to a counterpart terminal, and a tubular conductor connecting portion coaxially interposed between the insulator and an exposed terminal connecting portion of the outer conductor at a cable end portion of the coaxial cable, the conductor connecting portion being physically and electrically connected to the terminal connecting portion, a tubular crimping member that allows the terminal connecting portion to be coaxially interposed between the crimping member and the conductor connecting portion, the crimping member being deformed upon application of pressure applied radially inward to crimp the terminal connecting portion onto the conductor connecting portion, and a tubular member that is stronger and harder than the conductor connecting portion and is coaxially interposed between the conductor connecting portion and the insulator, wherein the linear conductors of the terminal connecting portion include crushed portions that abut each other such that circumferentially adjacent linear conductors that are spaced apart before the application of pressure are crushed and that a gap between the adjacent linear conductors is reduced by the crush under the pressure, the crushed portions abutting each other being crushed until the crushed portions are axially extended by an amount that achieves a target crushed state, the target crushed state being a state in which an oxide layer on the linear conductors is broken to obtain an exposed region of a new surface that is required for adhesion to the conductor connecting portion.

According to another aspect of the present invention, in the terminal crimping structure, the tubular member may be configured to exert, on the conductor connecting portion, a reaction force equal to a force exerted radially inward from the conductor connecting portion upon the application of pressure.

According to still another aspect of the present invention, in the terminal crimping structure, the tubular member may be configured not to deform upon the application of pressure.

A connector with a cable according to still another aspect of the present invention includes a coaxial cable including a pillar-shaped center conductor, a tubular insulator, and a tubular outer conductor coaxially disposed in this order from an axis, the outer conductor including a plurality of linear conductors made of aluminum or aluminum alloy, the linear conductors extending along an outer circumferential surface of the insulator in a direction that crosses a circumferential direction of the insulator to a cable axial direction, the linear conductors being arranged along the circumferential direction to virtually form the tubular outer conductor in a tubular shape, and a connector to which a cable end portion of the coaxial cable is connected, wherein the connector includes a terminal fitting including a terminal-to-terminal connecting portion that is physically and electrically connected to a counterpart terminal of a counterpart connector, and a tubular conductor connecting portion coaxially interposed between the insulator and an exposed terminal connecting portion of the outer conductor at the cable end portion, the conductor connecting portion being physically and electrically connected to the terminal connecting portion, a tubular crimping member that allows the terminal connecting portion to be coaxially interposed between the crimping member and the conductor connecting portion, the crimping member being deformed upon application of pressure applied radially inward to crimp the terminal connecting portion onto the conductor connecting portion, and a tubular member that is stronger and harder than the conductor connecting portion and is coaxially interposed between the conductor connecting portion and the insulator, and the linear conductors of the terminal connecting portion include crushed portions that abut each other such that circumferentially adjacent linear conductors that are spaced apart before the application of pressure are crushed and that a gap between the adjacent linear conductors are reduced by the crush under the pressure, the crushed portions abutting each other being crushed until the crushed portions are axially extended by an amount that achieves a target crushed state, the target crushed state being a state in which an oxide layer on the linear conductors is broken to obtain an exposed region of a new surface that is required for adhesion to the conductor connecting portion.

According to still another aspect of the present invention, in the connector with a cable, the coaxial cable may include the center conductor, a first insulator as the insulator, the outer conductor, a tubular second insulator different from the insulator, a tubular shield, and a tubular protective outer sheath coaxially disposed in this order from the axis, and the connector may include a first terminal fitting different from the terminal fitting, the first terminal fitting being physically and electrically connected to the center conductor, a second terminal fitting as the terminal fitting, a housing that stores therein the first terminal fitting and the second terminal fitting, and a shield shell that externally covers the housing and that is electrically connected to the shield.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

The following fully describes an embodiment of a terminal crimping structure and a connector with a cable according to the present invention with reference to the accompanying drawings. The embodiment is not intended to limit the scope of the present invention.

Embodiment

An embodiment of the terminal crimping structure and the connector with a cable according to the present invention will be described with reference to FIGS. 1 to 21.

The connector with a cable according to the present embodiment is illustrated by reference sign 1 in FIGS. 1 and 2. The terminal crimping structure according to the present embodiment is a technology used in the connector with a cable 1. The following mainly describes the connector with a cable 1 and describes the terminal crimping structure in accordance with the description of the connector.

The connector with a cable 1 is, for example, one of components included in a wire harness (not illustrated) routed in a vehicle. The wire harness, when used in a vehicle such as a hybrid vehicle or an electric vehicle that uses an electric motor for propulsion, connects a running drive system, which is not illustrated, such as a rotor (e.g., a motor for power or a generator for generating power) and a battery, and transmits power supplied from the battery to the rotor and transmits regenerative power from the rotor to the battery for recharging, for example. The connector with a cable 1 is one of the components of a wire harness that is routed along a lower surface of a floor panel FP (FIG. 2) close to the lower side of the vehicle. Such a wire harness is referred to, for example, as an under-floor wire harness. Ends of the under-floor wire harness are disposed above the floor through corresponding through-holes in the floor panel FP. A first end is connected to the drive system above the floor and a second end is connected to the battery above the floor. The connector with a cable 1 according to the present embodiment is provided, for example, on join portions of the second end of the under-floor wire harness above and below the floor. The connector with a cable 1 is disposed below the floor and is connected to a counterpart connector CN (FIG. 2) above the floor via a throughhole of the floor panel FP.

Figure 1:
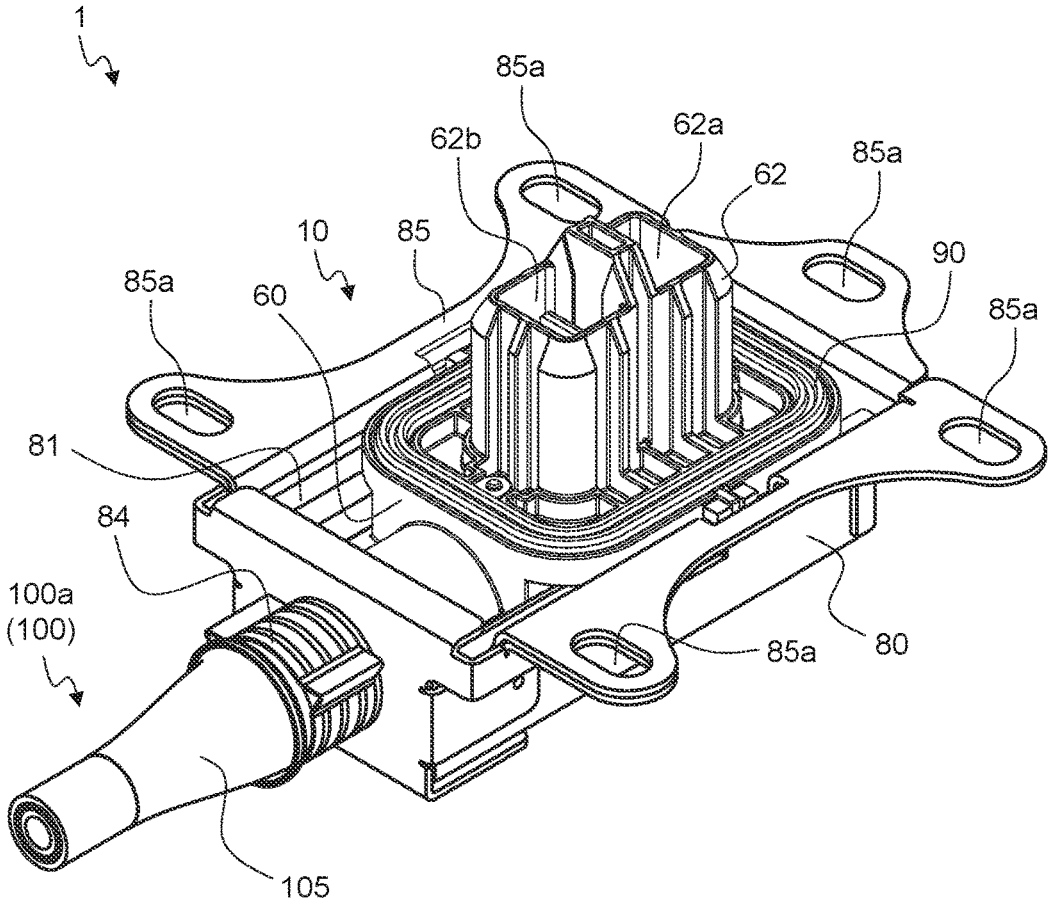
FIG. 1 is a perspective view of a connector with a cable according to an embodiment of the present invention.
Figure 2:
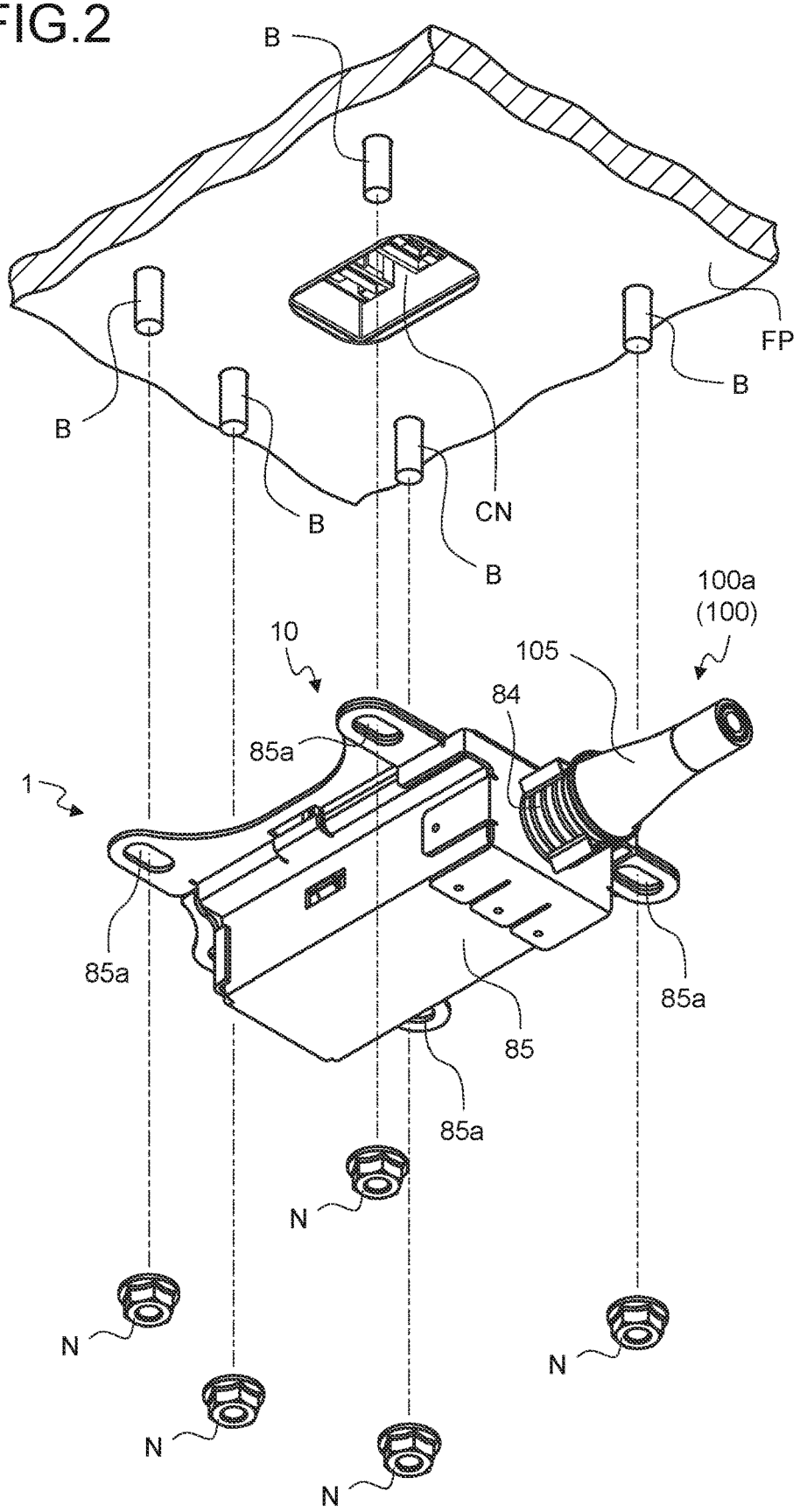
FIG. 2 is another perspective view of the connector with a cable according to the embodiment seen at a different angle.

The connector with a cable 1 includes a connector 10 and a coaxial cable 100, and is configured such that an end portion (hereinafter referred to as a "cable end portion") 100*a* of the coaxial cable 100 is physically and electrically connected to the connector 10 (FIGS. 1 and 2). The connector 10 is connected with the coaxial cable 100 having such a structure as described below. The structure of the coaxial cable 100 will be described first.

Figure 3:
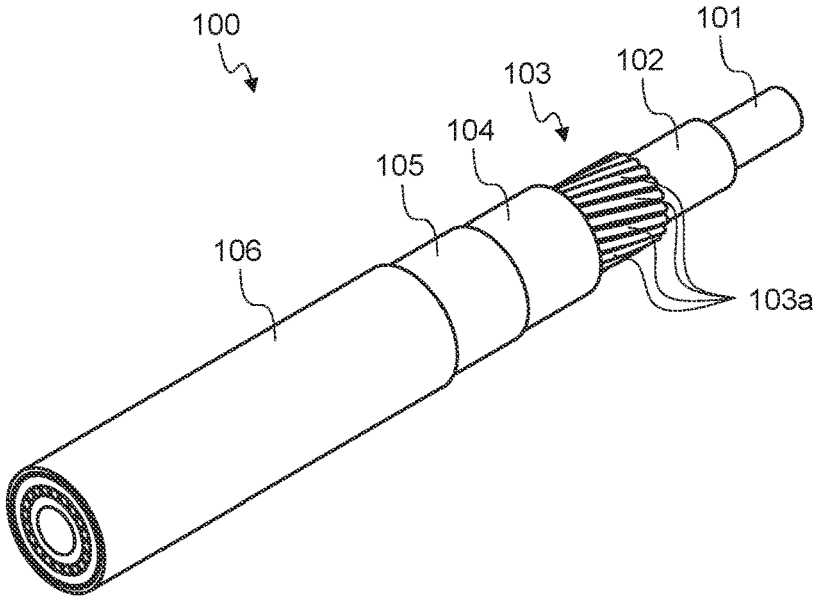
FIG. 3 is a perspective view illustrating a configuration of a coaxial cable according to the embodiment.
Figure 4:
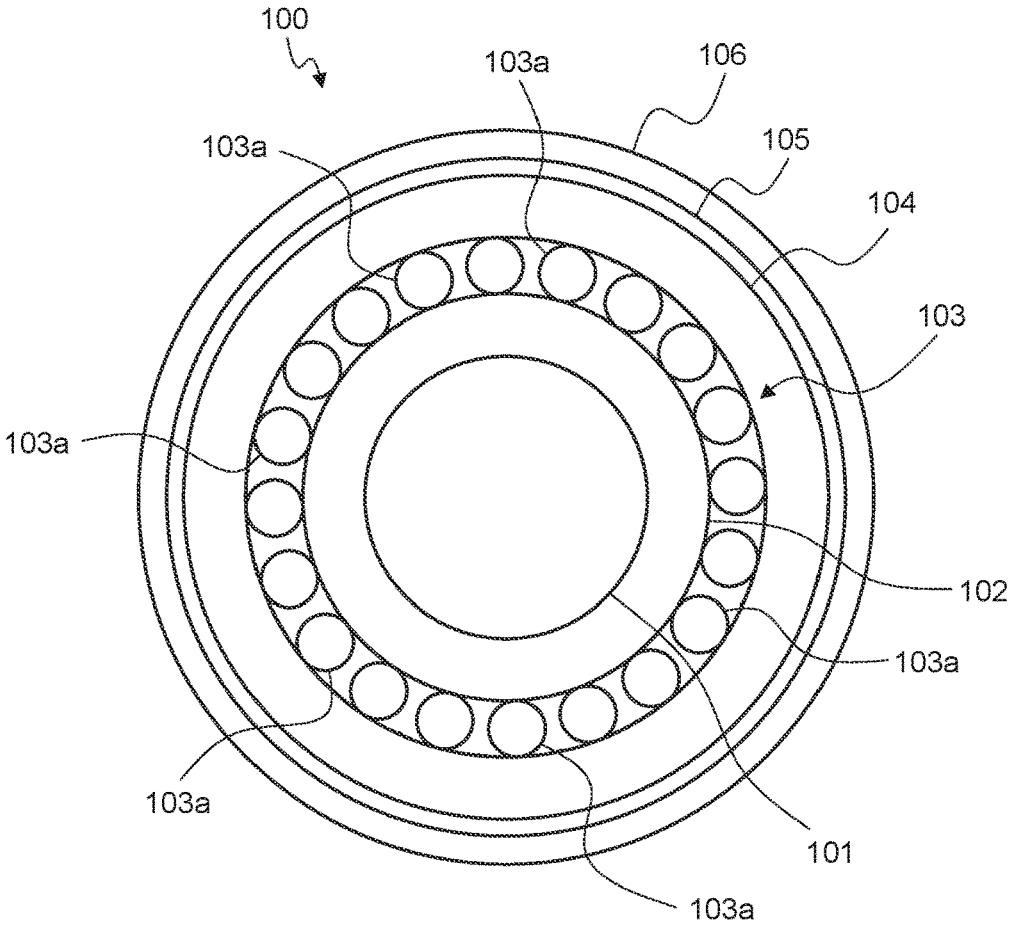
FIG. 4 is a diagram illustrating an end surface of the coaxial cable seen in the axial direction.

The coaxial cable 100 is a flexible cable including a center conductor 101, a first insulator 102, an outer conductor 103, a second insulator 104, a shield 105, and a protective outer sheath 106 (FIGS. 3 and 4). The coaxial cable 100 includes the pillar-shaped center conductor 101, the tubular first insulator 102, the tubular outer conductor 103, the tubular second insulator 104, the tubular shield 105, and the tubular protective outer sheath 106 that are coaxially disposed in this order from the axis.

The center conductor 101 is one of two conductors included in the coaxial cable 100. The center conductor 101 is a pillar-shaped conductor made of a conductive material such as metal, and extends with its axis along the axial direction of the coaxial cable 100 (hereinafter referred to as a "cable axial direction"). In the present example, the center conductor 101 is a circular pillar-shaped conductor made of aluminum or aluminum alloy. The center conductor 101 may be, for example, a circular pillar-shaped solid wire or a stranded wire composed of a plurality of element wires.

The first insulator 102 is one of two insulators included in the coaxial cable 100. The first insulator 102 is a tubular insulator made of an insulating material such as synthetic resin, and covers the outer circumferential surface of the center conductor 101 with its inner circumferential surface. In the present example, the first insulator 102 is a circular tubular insulator and is disposed coaxially with respect to the center conductor 101.

The outer conductor 103 is the other one of the two conductors included in the coaxial cable 100. The outer conductor 103 is composed of a plurality of linear conductors 103*a* extending along the outer circumferential surface of the first insulator 102 in a direction that crosses the circumferential direction of the first insulator 102 to the cable axis direction. The linear conductors 103*a* are linear wire conductors made of a conductive material such as metal. In the present example, the linear conductors 103*a* are made of aluminum or aluminum alloy. The linear conductors 103*a* are circumferentially arranged around the first insulator 102 to virtually form the tubular outer conductor 103. In the present example, the linear conductors 103*a* are arranged to form a circular tubular outer conductor 103. The outer conductor 103 is disposed coaxially with respect to, for example, the center conductor 101.

The second insulator 104 is the other one of the two insulators included in the coaxial cable 100. The second insulator 104 is a tubular insulator made of an insulating material such as synthetic resin, and covers the virtually tubular outer circumferential surface of the outer conductor 103 with its inner circumferential surface. In the present example, the second insulator 104 is a circular tubular insulator and is disposed coaxially with respect to, for example, the center conductor 101.

The shield 105 is a tubular conductor that covers the outer circumferential surface of the second insulator 104 with its inner circumferential surface, and is made of a conductive material such as metal. For example, the shield 105 may be a tubular woven shield composed of a plurality of element wires, or may be a tubular metal foil shield. In the present example, the shield 105 is a circular tubular shield and is disposed coaxially with respect to, for example, the center conductor 101.

The protective outer sheath 106 is a tubular sheath that covers the outer circumferential surface of the shield 105 with its inner circumferential surface, and is made of an insulating material such as synthetic resin. In the present example, the protective outer sheath 106 is a circular tubular sheath and is disposed coaxially with respect to, for example, the center conductor 101.

At the cable end portion 100*a* of the coaxial cable 100 to which the connector 10 is connected, the first insulator 102, the outer conductor 103, the second insulator 104, the shield 105, and the protective outer sheath 106 are stripped as appropriate such that the center conductor 101, the first insulator 102, the outer conductor 103, the second insulator 104, and the shield 105 are exposed in predetermined respective lengths in the cable axis direction. In the coaxial cable 100, the exposed portion of the center conductor 101 is a terminal connecting portion 101*a* (FIGS. 6 to 8) to be connected to a terminal (a first terminal fitting 20 to be described below with reference to FIG. 5) of the connector 10, and the exposed portion of the outer conductor 103 is a terminal connecting portion 103*b* (FIGS. 6 to 8) to be connected to another terminal (a second terminal fitting 30 to be described below with reference to FIG. 5) of the connector 10.

The connector 10 is described next.

Referring to the example of the vehicle above, the connector 10 is mounted on the lower surface of the floor panel FP and is fitted with the counterpart connector CN above the floor via a throughhole of the floor panel FP. In the present example, the connector 10 is inserted into the counterpart connector CN in a direction from below to above the floor, which is a connector insertion direction, whereas disconnected from the counterpart connector CN in a direction from above to below the floor, which is a connector disconnection direction. In the present example, the axial direction of the throughhole of the floor panel FP is the connector insertion and disconnection direction of the connector 10 relative to the counterpart connector CN. The counterpart connector CN is mounted on the upper surface of the floor panel FP, and is connected to an electrical junction box via a coaxial cable having the same configuration as the coaxial cable 100 or an electric wire.

Figure 5:
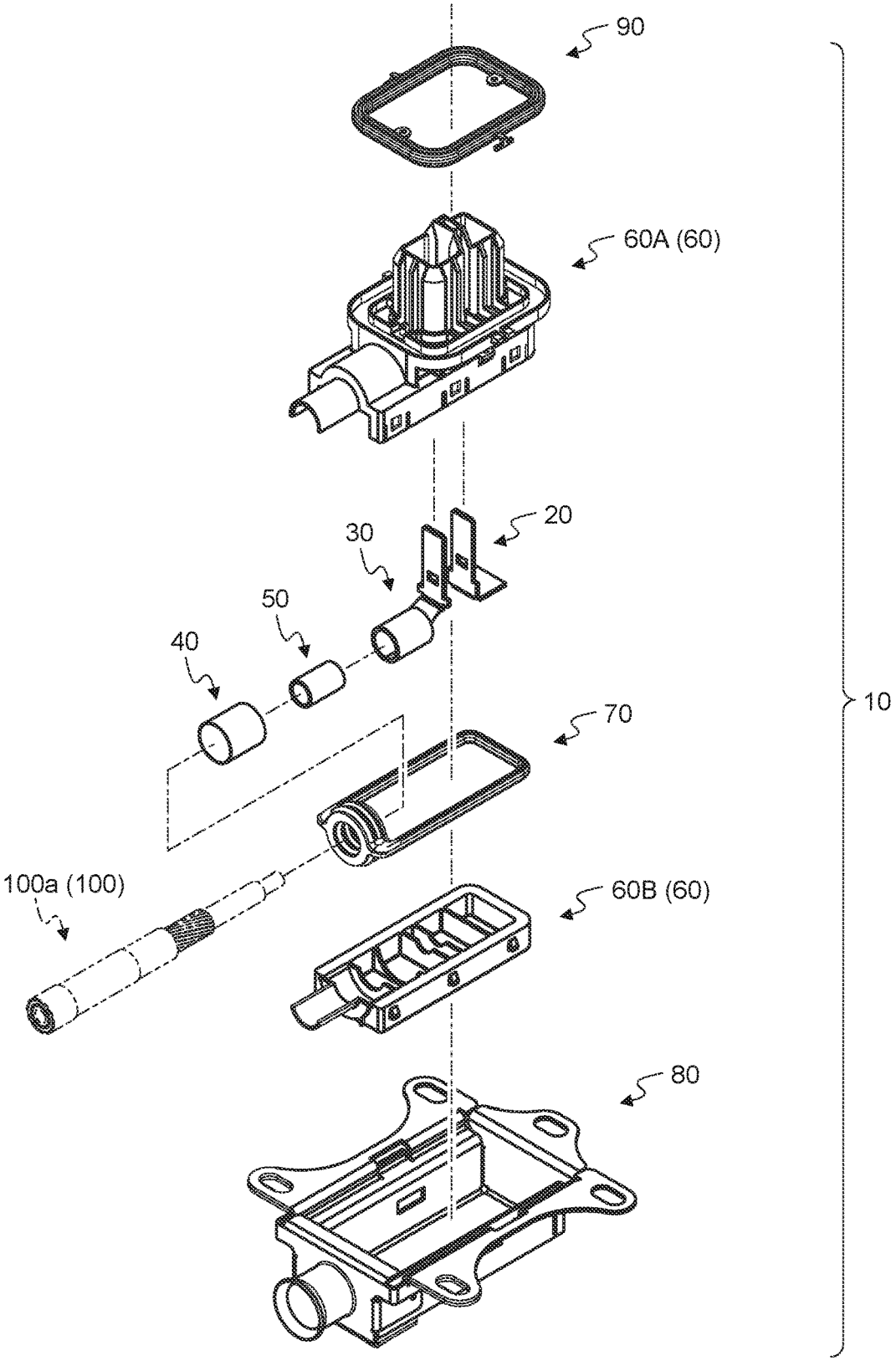
FIG. 5 is an exploded perspective view of a connector.

The connector 10 includes the first terminal fitting 20, the second terminal fitting 30, a crimping member 40, a tubular member 50, a housing 60, a first sealing member 70, a shield shell 80, and a second sealing member 90 (FIG. 5).

In the connector 10, a connector insertion and extraction direction means that a terminal-to-terminal connecting portion 21 to be described below is inserted into or extracted from a first counterpart terminal, and a terminal-to-terminal connecting portion 31 to be described below is inserted into or extracted from a second counterpart terminal. In this configuration, the first terminal fitting 20 and the second terminal fitting 30 are disposed such that the terminal-to-terminal connecting portions 21 and 31 protrude in the same direction from conductor connecting portions 22 and 32. In the connector with a cable 1 in the present example, the first terminal fitting 20 and the second terminal fitting 30 are aligned in the cable axis direction. The following describes the individual components of the connector 10.

Figure 6:
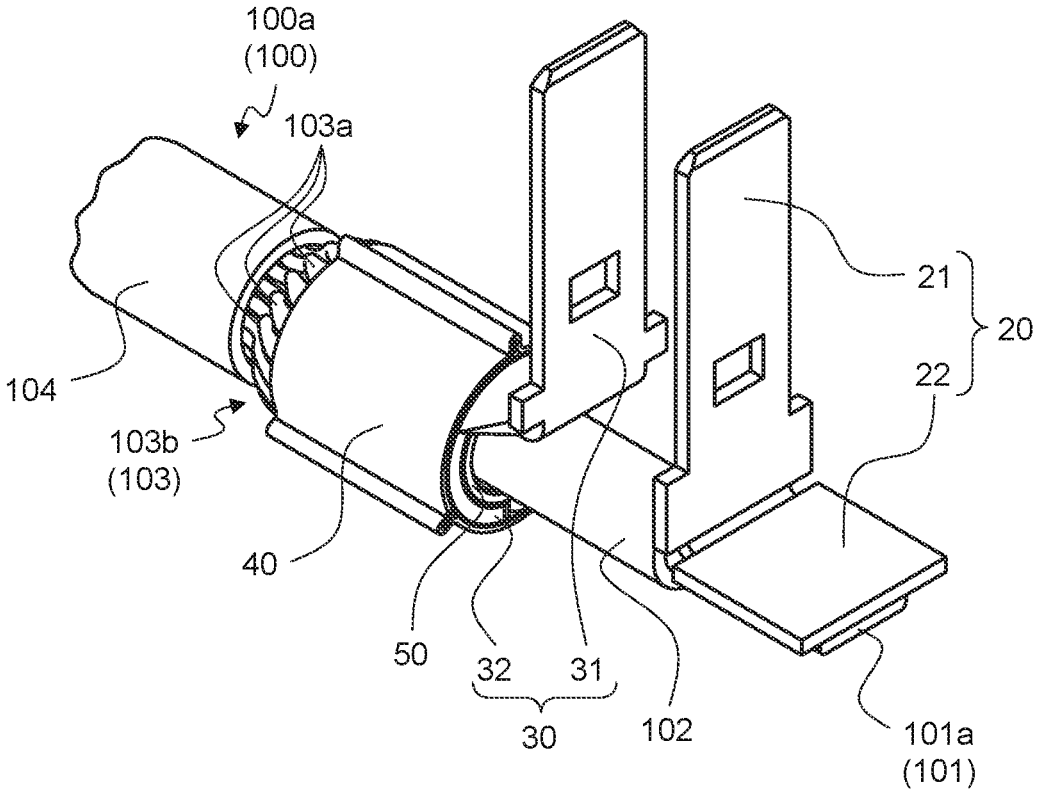
FIG. 6 is a perspective view of a coaxial cable to which a first terminal fitting and a second terminal fitting are connected.
Figure 7:
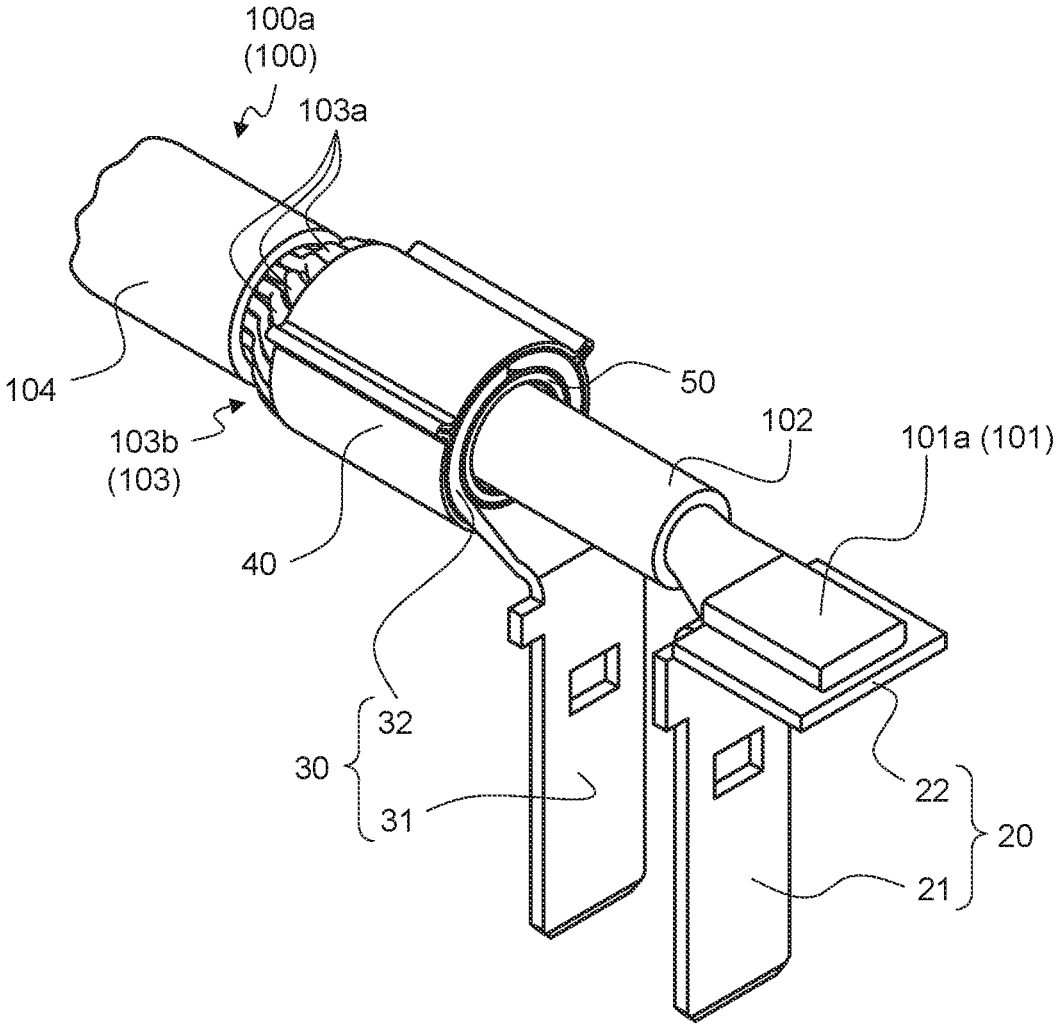
FIG. 7 is another perspective view of the coaxial cable to which the first terminal fitting and the second terminal fitting are connected seen at a different angle.
Figure 8:
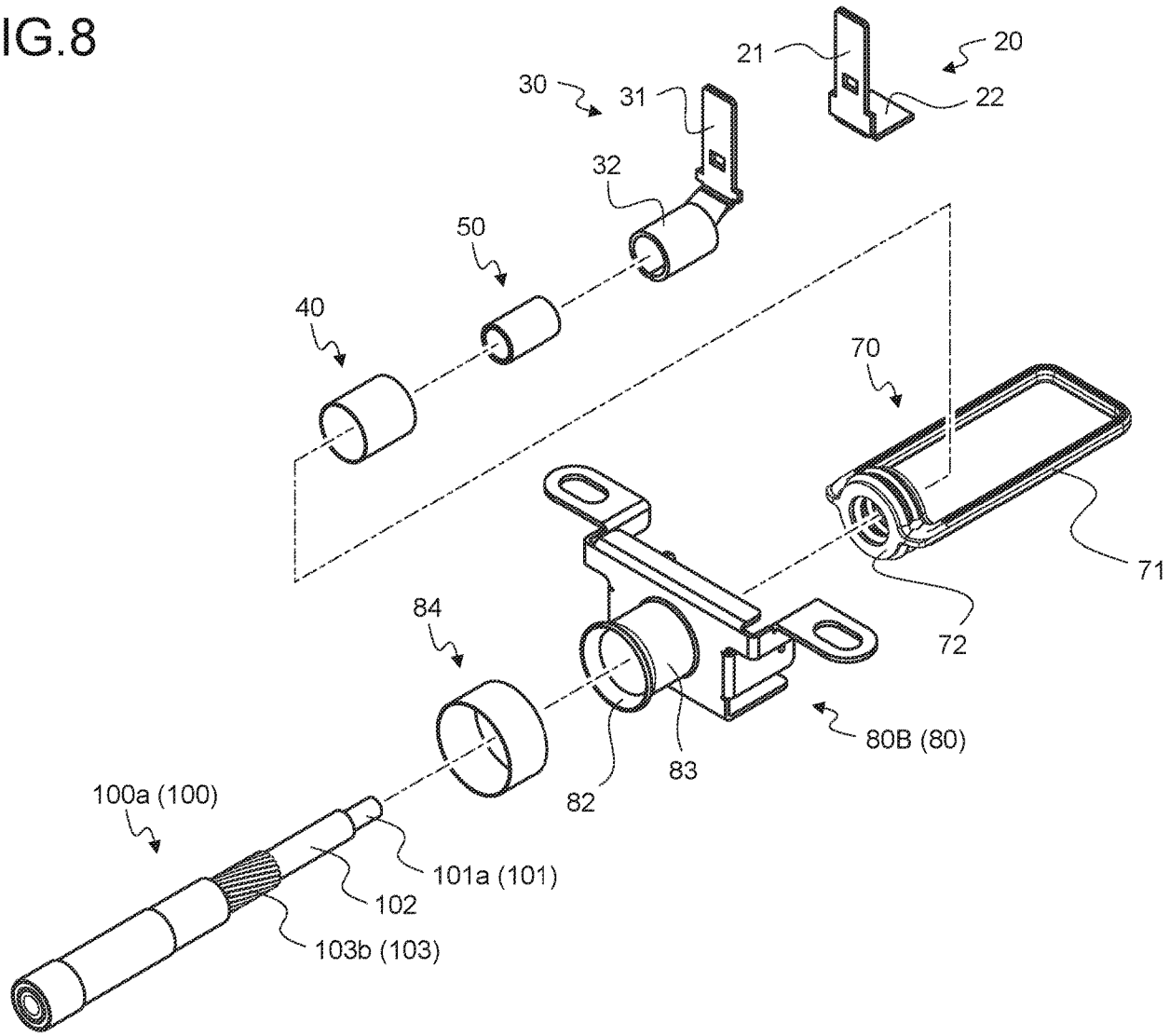
FIG. 8 is an exploded perspective view illustrating the coaxial cable and parts to be connected or mounted on the coaxial cable.

The first terminal fitting 20 is one of two terminal fittings included in the connector 10, and is made of a conductive material such as metal. The first terminal fitting 20 electrically connects the first counterpart terminal (not illustrated) of the counterpart connector CN with the center conductor 101 of the coaxial cable 100. The first terminal fitting 20 in the present example is a press-molded part made of copper sheet. The first terminal fitting 20 includes the terminal-to-terminal connecting portion 21 that is physically and electrically connected to the first counterpart terminal, and the conductor connecting portion 22 that is physically and electrically connected to the exposed terminal connecting portion 101*a* of the center conductor 101 (FIGS. 6 to 8). The first terminal fitting 20 in the present example is an L-shaped terminal in which the terminal-to-terminal connecting portion 21 and the conductor connecting portion 22 are disposed crossing each other (perpendicular to each other in the present example).

The terminal-to-terminal connecting portion 21 is a female-ended portion if the first counterpart terminal is a male-ended terminal, whereas the terminal-to-terminal connecting portion 21 is a male-ended portion if the first counterpart terminal is a female-ended terminal. The terminal-to-terminal connecting portion 21 in the present example is a rectangular male-ended tip portion, and is inserted into and fitted with the female-ended first counterpart terminal and physically and electrically connected thereto.

The conductor connecting portion 22 in the present example is a rectangular tip portion having a planar surface to which the terminal connecting portion 101*a* of the center conductor 101, which is made of aluminum or aluminum alloy, is joined by ultrasonic welding, for example. The ultrasonic welding technology breaks or removes an oxide layer on the surface of the terminal connecting portion 101*a*, and a new surface can be exposed. This configuration allows the terminal connecting portion 101*a* of the center conductor 101 to tightly adhere to the planar surface of the conductor connecting portion 22 of the first terminal fitting 20.

The second terminal fitting 30 is the other one of the two terminal fittings included in the connector 10, and is made of a conductive material such as metal. The second terminal fitting 30 electrically connects the second counterpart terminal (not illustrated) of the counterpart connector CN with the outer conductor 103 of the coaxial cable 100. The second terminal fitting 30 in the present example is a press-molded part made of copper sheet. The second terminal fitting 30 includes the terminal-to-terminal connecting portion 31 that is physically and electrically connected to the second counterpart terminal, and the conductor connecting portion 32 that is physically and electrically connected to the exposed terminal connecting portion 103*b* of the outer conductor 103 (FIGS. 6 to 8). The second terminal fitting 30 in the present example is an L-shaped terminal in which the terminal-to-terminal connecting portion 31 and the conductor connecting portion 32 are disposed to cross each other (perpendicular to each other in the present example).

The terminal-to-terminal connecting portion 31 is a female-ended portion if the second counterpart terminal is a male-ended terminal, whereas the terminal-to-terminal connecting portion 31 is a male-ended portion if the second counterpart terminal is a female-ended terminal. The terminal-to-terminal connecting portion 31 in the present example is a rectangular male-ended tip portion, and is inserted into and fitted with the female-ended second counterpart terminal and physically and electrically connected thereto.

Figure 9:
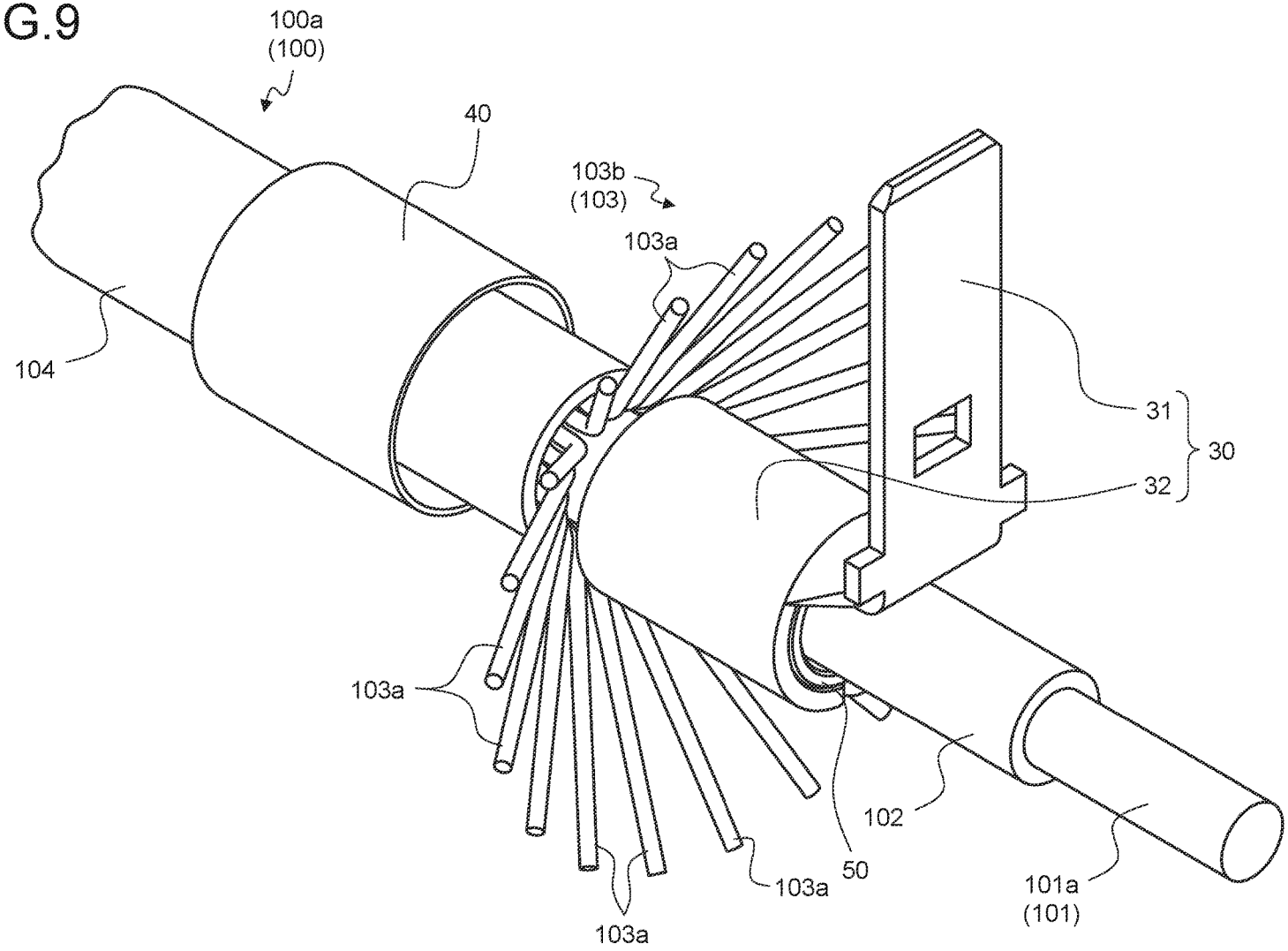
FIG. 9 is a perspective view illustrating how the second terminal fitting and a tubular member are set to the coaxial cable.
Figure 10:
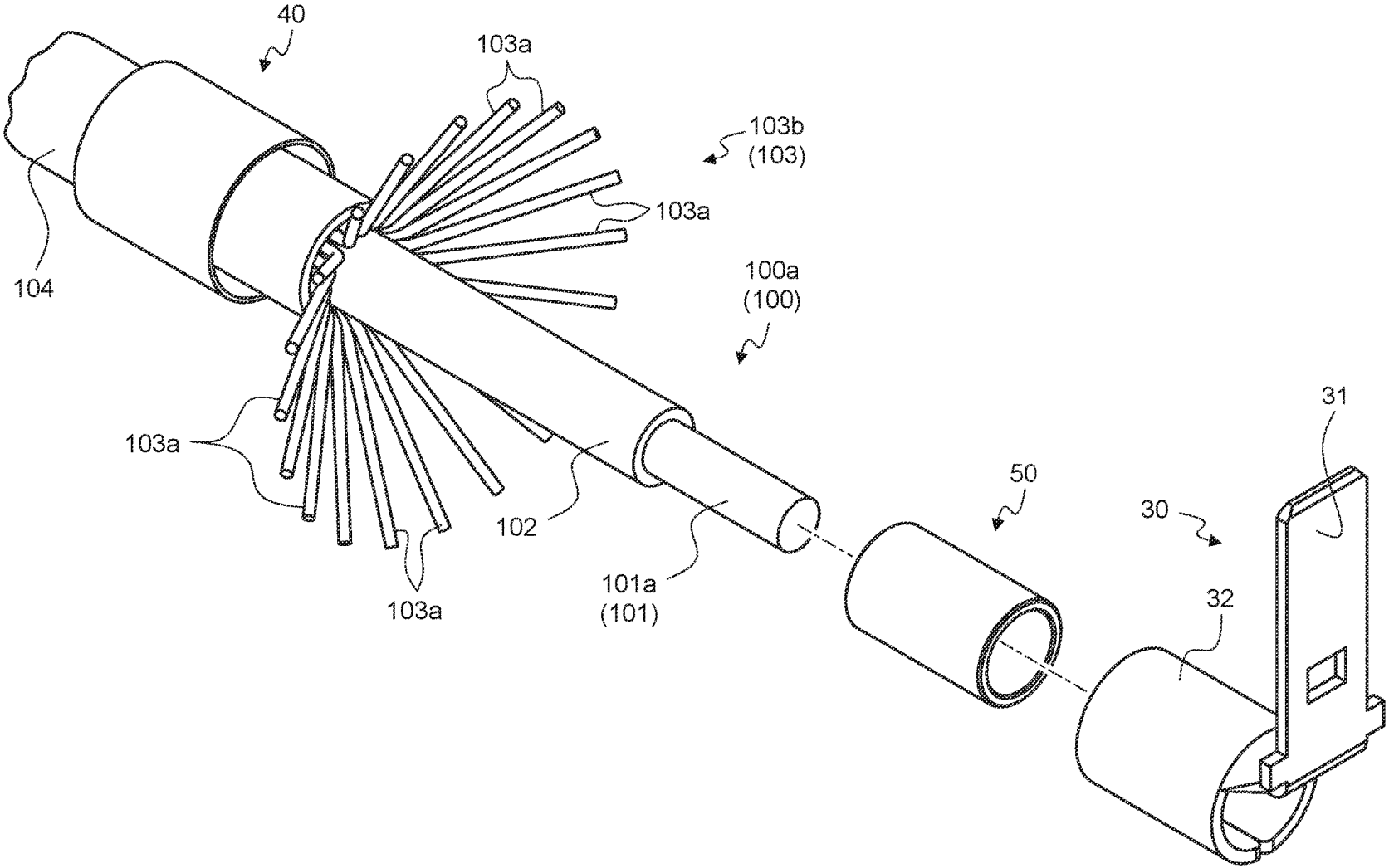
FIG. 10 is a perspective view illustrating a state before the second terminal fitting and the tubular member are set to the coaxial cable.

The conductor connecting portion 32 is a tubular portion into which the cable end portion 100*a* of the coaxial cable 100 is inserted (FIGS. 8 to 10). The conductor connecting portion 32 in the present example is a straight circular tube. The conductor connecting portion 32 is set such that the terminal connecting portion 103*b* of the outer conductor 103 is disposed around the outer circumferential surface of the conductor connecting portion 32, and the center conductor 101 and the first insulator 102 are inserted into the conductor connecting portion 32 (FIGS. 9 and 10). The outer circumferential surface of the conductor connecting portion 32 is covered with the virtually tubular inner circumferential surface of the terminal connecting portion 103*b*. In other words, the tubular conductor connecting portion 32 is coaxially interposed between the first insulator 102 and the terminal connecting portion 103*b* of the outer conductor 103, whereby the terminal connecting portion 103*b* is physically and electrically connected to the outer circumferential surface of the conductor connecting portion 32. The tubular member 50 is coaxially interposed between the conductor connecting portion 32 and the first insulator 102, which will be described later. The conductor connecting portion 32 in the present example has an inner diameter equal to the outer diameter of the tubular member 50 as far as the tubular member 50 can be interposed therebetween.

The crimping member 40 is provided to physically and electrically connect the conductor connecting portion 32 with the terminal connecting portion 103*b*. The crimping member 40 is a tubular member made of a conductive material such as metal, and into which the cable end portion 100*a* of the coaxial cable 100 is inserted (FIGS. 8 to 10). The crimping member 40 in the present example is a straight circular tube that allows the virtually tubular terminal connecting portion 103*b* to be coaxially interposed between the crimping member 40 and the conductor connecting portion 32. It should be noted that the cable end portion 100*a* is inserted into the crimping member 40 before the cable end portion 100*a* is inserted into the conductor connecting portion 32. It is desirable that the crimping member 40 is temporarily retracted at least to the second insulator 104 until the second terminal fitting 30 is set to the cable end portion 100*a*. Thus, the crimping member 40 has an inner diameter larger than the outer diameter of the second insulator 104.

The tubular crimping member 40 is deformed upon application of pressure exerted radially inward, and crimps the terminal connecting portion 103*b* onto the conductor connecting portion 32 as it is deformed, and thus, the terminal connecting portion 103*b* is physically and electrically connected to the conductor connecting portion 32. This crimp process is performed by using a plurality of crimping dies Mm (FIGS. 11 and 12) circumferentially arranged with a gap therebetween. Each crimping die Mm has an ark-shaped inner circumferential surface Mm1 that tightly contacts a portion, arranged circumferentially, of the outer circumferential surface of the conductor connecting portion 32, and applies pressure thereto in response to pressure applied on the outer circumferential surface.

The crimping dies Mm are configured to reciprocate radially inward and outward. Pressure is applied to the outer circumferential surface of the conductor connecting portion 32 when the crimping dies Mm move radially inward. Adjacent crimping dies Mm, which are circumferentially spaced apart, come closer to each other as they move radially inward, and their inner circumferential surfaces Mm1 are circumferentially joined with each other to form a circular pillar space. The diameter of the circular pillar space formed by the crimping dies Mm is smaller than the outer diameter of the crimping member 40. With this configuration, the crimping dies Mm can apply pressure radially inward to the outer circumferential surface of the crimping member 40 with their inner circumferential surfaces Mm1 as the crimping dies Mm move radially inward. Upon application of pressure, the crimping member 40 is deformed radially inward at press positions of the crimping dies Mm. The force exerted radially inward in the deformation is exerted on the outer circumferential surface of the conductor connecting portion 32 via the terminal connecting portion 103*b* of the outer conductor 103. The crimping member 40 is swaged onto the terminal connecting portion 103*b* and the conductor connecting portion 32, thereby crimping the linear conductors 103*a* of the terminal connecting portion 103*b* onto the outer circumferential surface of the conductor connecting portion 32.

In this crimp process, it is desirable that the linear conductors 103*a* of the terminal connecting portion 103*b* are crushed by the crimping member 40 until the oxide layer on the surface is cracked or removed to expose a new surface, and that the linear conductors 103*a* tightly adhere to the outer circumferential surface of the conductor connecting portion 32. The force exerted radially inward in the deformation of the crimping member 40 is exerted on the conductor connecting portion 32, and then is exerted radially inward on the coaxial cable 100 from the conductor connecting portion 32. The conductor connecting portion 32 of the connector 10 accommodates therein the flexible center conductor 101 and first insulator 102 of the coaxial cable 100. With this flexibility, it is difficult for the coaxial cable 100 to evenly receive the force of the crimping dies Mm exerted from the conductor connecting portion 32 and to exert an equal reaction force on the conductor connecting portion 32. This situation may lead to deformation of the conductor connecting portion 32, and force that should be exerted from the linear conductors 103*a* of the terminal connecting portion 103*b* on the outer circumferential surface of the conductor connecting portion 32 escapes, accordingly. It is, therefore, difficult for the linear conductors 103*a* to tightly adhere to the outer circumferential surface of the conductor connecting portion 32.

To solve this problem, one solution is to increase the hardness of the first insulator 102, however, this solution may lose flexibility of the coaxial cable 100. The connector with a cable 1 according to the present embodiment has a terminal crimping structure in which the tubular member 50 is interposed between the conductor connecting portion 32 and the first insulator 102 to allow the terminal connecting portion 103*b* to more firmly adhere to the outer circumferential surface of the conductor connecting portion 32, and to increase crimping accuracy between the conductor connecting portion 32 and the terminal connecting portion 103*b*. In the terminal crimping structure, the tubular member 50 is coaxially interposed therebetween (FIGS. 6, 7, and 9 to 12). In the terminal crimping structure, the tubular member 50 evenly receives the force exerted from the conductor connecting portion 32 upon application of pressure by the crimping dies Mm, and exerts an equal reaction force on the conductor connecting portion 32. This configuration prevents deformation of the conductor connecting portion 32 and increases crimping accuracy between the conductor connecting portion 32 and the terminal connecting portion 103*b*. If the amount of pressure or the timing of application of the pressure varies within the range of tolerance at the respective press positions, forces exerted from the conductor connecting portion 32 vary accordingly. However, the amount of pressure and the timing of application of the pressure are deemed to be equal as long as they are within the range of tolerance.

The tubular member 50 is coaxially interposed between the conductor connecting portion 32 of the second terminal fitting 30 and the first insulator 102 when the outer conductor 103 is crimped onto the second terminal fitting 30. The tubular member 50 in the present example is a straight circular tube. The conductor connecting portion 32 has an inner diameter equal to the outer diameter of the tubular member 50 to allow the tubular member 50 to be interposed therebetween.

The tubular member 50 is configured to exert an equal reaction force on the conductor connecting portion 32 when force is exerted radially inward from the conductor connecting portion 32 upon application of pressure by the crimping dies Mm. In other words, although the crimping member 40 is swaged and deformed upon application of pressure by the crimping dies Mm located circumferentially at the respective press positions, the tubular member 50 is strong enough to allow the crimping member 40 to be swaged and deformed substantially evenly at the respective press positions. For example, the tubular member 50 is configured to be stronger and harder than the conductor connecting portion 32. More preferably, the tubular member 50 is configured not to allow the conductor connecting portion 32 to deform upon application of pressure by the crimping dies Mm. The tubular member 50 may be made of any material that can achieve such desired strength. For example, the tubular member 50 is made of a metal material.

When the crimping dies Mm apply pressure radially inward to the crimping member 40, the tubular member 50 can evenly receive the forces of the pressure from the conductor connecting portion 32 and can exert equal reaction forces on the conductor connecting portion 32. The terminal crimping structure allows the crimping member 40 to deform substantially evenly at the respective press positions, thereby crushing the linear conductors 103*a* of the terminal connecting portion 103*b* substantially evenly by a desired amount of crush between the crimping member 40 and the conductor connecting portion 32.

Figure 12:
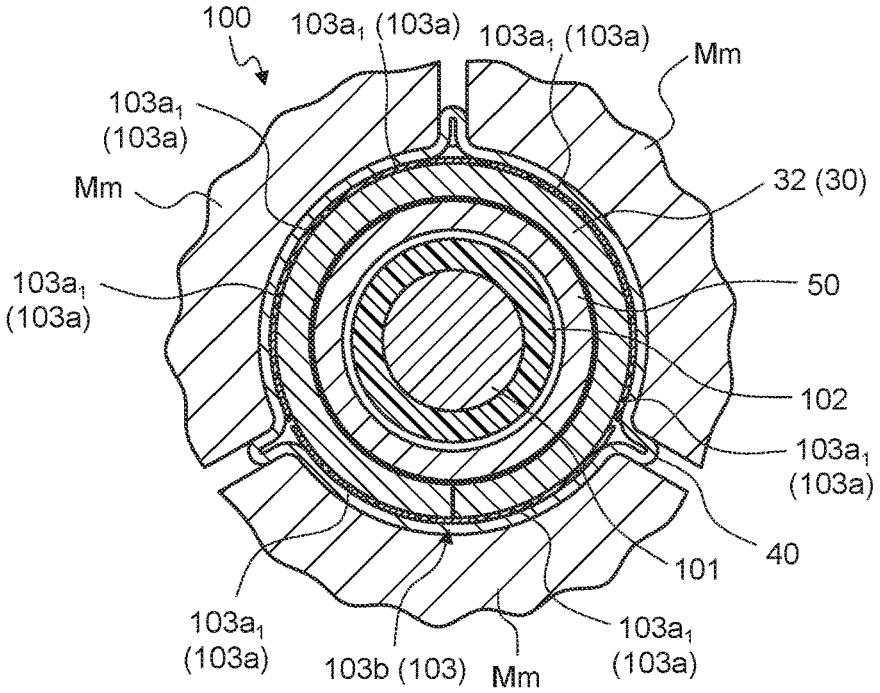
FIG. 12 is a diagram schematically illustrating the crimping dies for crimping the second terminal fitting, and illustrating a cross section of the second terminal fitting and the coaxial cable being crimped.

The linear conductors 103*a* of the terminal connecting portion 103*b* are crushed between the crimping member 40 and the conductor connecting portion 32, and crushed portions $\mathbf{103}a_1$ are formed thereon (FIG. 12). The crushed portions $\mathbf{103}a_1$ provide an exposed region of a new surface required for adhesion to the conductor connecting portion 32. The crushed portions $\mathbf{103}a_1$ are crushed to achieve a certain crushed state in which the oxide layer is broken to obtain a desired exposed region. The crushed state described above is referred to as a target crushed state.

Figure 11:
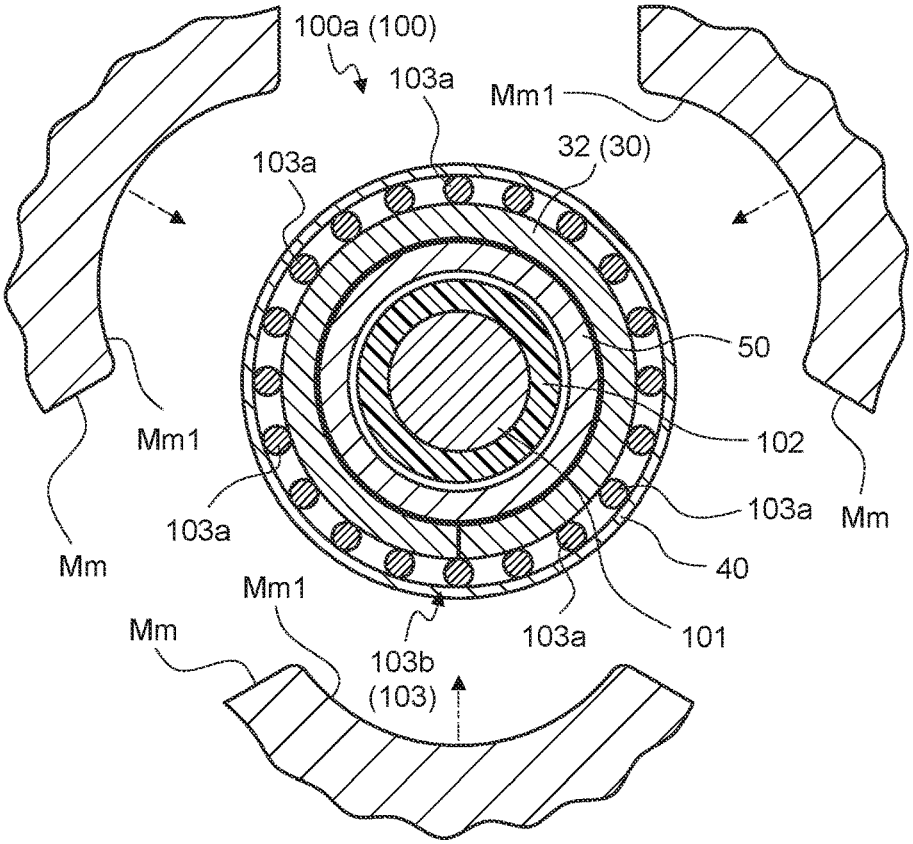
FIG. 11 is a diagram schematically illustrating crimping dies for crimping the second terminal fitting, and illustrating a cross section of the second terminal fitting and the coaxial cable before being crimped.

The linear conductors 103*a* of the terminal connecting portion 103*b*, for example, accommodate therein the conductor connecting portion 32 and the tubular member 50, and thus, adjacent linear conductors 103*a* are circumferentially spaced apart on the outer circumferential surface of the conductor connecting portion 32 before application of pressure by the crimping dies Mm (FIG. 11). When a force is radially exerted on the linear conductors 103*a* of the terminal connecting portion 103*b* between the crimping member 40 and the conductor connecting portion 32 upon application of pressure, the linear conductors 103*a* are axially extended, and radially expanded circumferentially along the inner circumferential surface of the crimping member 40 and along the outer circumferential surface of the conductor connecting portion 32, and crushed.

The linear conductors 103*a* of the terminal connecting portion 103*b* are axially extended and crushed, and the crushed portions 103$a_1$ are formed. The crushed portions 103$a_1$ are crushed until they are axially extended by an amount that achieves the target crushed state. The linear conductors 103*a* of the terminal connecting portion 103*b* are axially extended and crushed substantially evenly until the target crushed state is achieved. The oxide layer on the surface of the linear conductors 103*a* is broken at the respective crushed portions 103$a_1$, and a new surface having a desired exposed region is exposed. The terminal crimping structure allows the linear conductors 103*a* of the terminal connecting portion 103*b* to adhere substantially evenly to the outer circumferential surface of the conductor connecting portion 32, thereby increasing crimping accuracy between the conductor connecting portion 32 and the outer conductor 103.

If the crushed portions 103$a_1$ fail to be extended by an amount that achieves the target crushed state, the amount of the gap between adjacent linear conductors 103*a* of the terminal connecting portion 103*b* on the outer circumferential surface of the conductor connecting portion 32 before application of pressure may be determined as appropriate so that the crushed portions 103$a_1$ can be extended by this amount. When, for example, the crimping dies Mm apply pressure radially inward to the crimping member 40, the linear conductors 103*a* of the terminal connecting portion 103*b* are, as described above, axially extended and radially expanded, and crushed. Adjacent linear conductors 103*a* of the terminal connecting portion 103*b*, which are radially expanded, then abut each other, so that the force exerted on the linear conductors 103*a* upon application of pressure by the crimping dies Mm is axially released, and the linear conductors 103*a* are axially extended. The linear conductors 103*a* of the terminal connecting portion 103*b* are arranged such that adjacent linear conductors 103*a* on the outer circumferential surface of the conductor connecting portion 32 before application of pressure are spaced apart with a gap therebetween that allows the linear conductors 103*a* to extend by an amount that achieves the target crushed state. The crushed portions 103$a_1$ are portions that abut each other such that circumferentially adjacent linear conductors that are spaced apart before application of pressure are crushed upon the application of pressure and that a gap therebetween is reduced. The crushed portions abutting each other are crushed until the crushed portions are axially extended by an amount that achieves the target crushed state. The linear conductors 103*a* of the terminal connecting portion 103*b* are further axially extended after abutting each other and are crushed substantially evenly until the target crushed state is achieved. The oxide layer on the surface of the linear conductors 103*a* is broken at the respective crushed portions 103$a_1$, and a new surface having a desired exposed region is exposed. This terminal crimping structure allows the linear conductors 103*a* of the terminal connecting portion 103*b* to adhere substantially evenly to the outer circumferential surface of the conductor connecting portion 32, thereby increasing crimping accuracy between the conductor connecting portion 32 and the outer conductor 103.

The tubular member 50 is provided to create such crushed portions 103$a_1$. It is desirable that the tubular member 50 has an axial length as long as or longer than the conductor connecting portion 32 to cover all the area inside the conductor connecting portion 32 in the cable axial direction. In other words, it is desirable that the tubular member 50 is configured to receive the force exerted from the conductor connecting portion 32 upon application of pressure by the crimping dies Mm at all the area in the cable axial direction.

The connector with a cable 1 may include a serration region at least on the outer circumferential surface of the conductor connecting portion 32 or on the inner circumferential surface of the crimping member 40. The serration region is provided at least on a region at which the crushed portions 103$a_1$ are formed at least on the outer circumferential surface of the conductor connecting portion 32 or on the inner circumferential surface of the crimping member 40. The serration region includes, for example, a plurality of recessed portions, a plurality of raised portions, or a combination of a plurality of recessed and raised portions in an arranged manner. The edges of the recessed portions or the like in the serration region scrape the oxide layer on the surface of the linear conductors 103*a* of the terminal connecting portion 103*b* as the linear conductors 103*a* are crushed upon application of pressure, and the exposed region of the new surface can be increased. Providing the serration region in the terminal crimping structure can further increase the crimping accuracy between the conductor connecting portion 32 and the outer conductor 103.

In the connector 10, the housing 60 stores therein the first terminal fitting 20, the second terminal fitting 30, the crimping member 40, and the tubular member 50 together with the cable end portion 100*a* of the coaxial cable 100.

Figure 13:
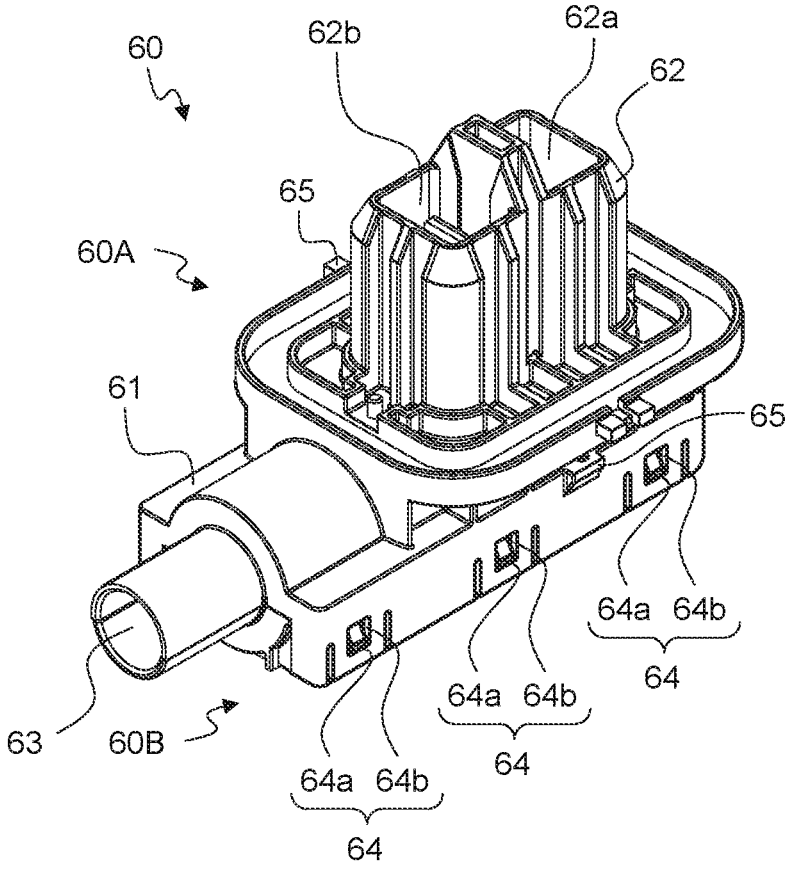
FIG. 13 is a perspective view of a housing.

The housing 60 is made of an insulating material such as synthetic resin. The housing 60 includes a base 61 having a rectangular parallelepiped shape and a mating portion (hereinafter referred to as a "connector mating portion") 62 protruding from the base 61 in the connector insertion direction (FIG. 13).

The base 61 has an inner space in which the conductor connecting portion 22 of the first terminal fitting 20, the conductor connecting portion 32 of the second terminal fitting 30, the crimping member 40, the tubular member 50, and the cable end portion 100*a* are accommodated. The coaxial cable 100 is drawn from the inside of the base 61 to the outside in a direction that crosses (in the present example, a direction perpendicular to) the connector insertion and disconnection direction. The base 61 includes a drawn hole 63 through which the coaxial cable 100 is drawn. The drawn hole 63 is a circular throughhole formed on a surface of the base 61.

The connector mating portion 62 accommodates therein the terminal-to-terminal connecting portion 21 of the first terminal fitting 20 and the terminal-to-terminal connecting portion 31 of the second terminal fitting 30. The connector mating portion 62 includes, in its inner space, a first terminal storage 62*a* that stores therein the terminal-to-terminal connecting portion 21, and a second terminal storage 62*b* that stores therein the terminal-to-terminal connecting portion 31. The first terminal storage 62*a* and the second terminal storage 62*b* have openings at an end of the connector mating portion 62 in the protruding direction. The connector mating portion 62 is fitted with a mating portion (hereinafter referred to as a counterpart mating portion) of the counterpart connector CN, and the terminal-to-terminal connecting portion 21 and the terminal-to-terminal connecting portion 31 are fitted with the first counterpart terminal and the second counterpart terminal, respectively, in the counterpart mating portion.

Figure 14:
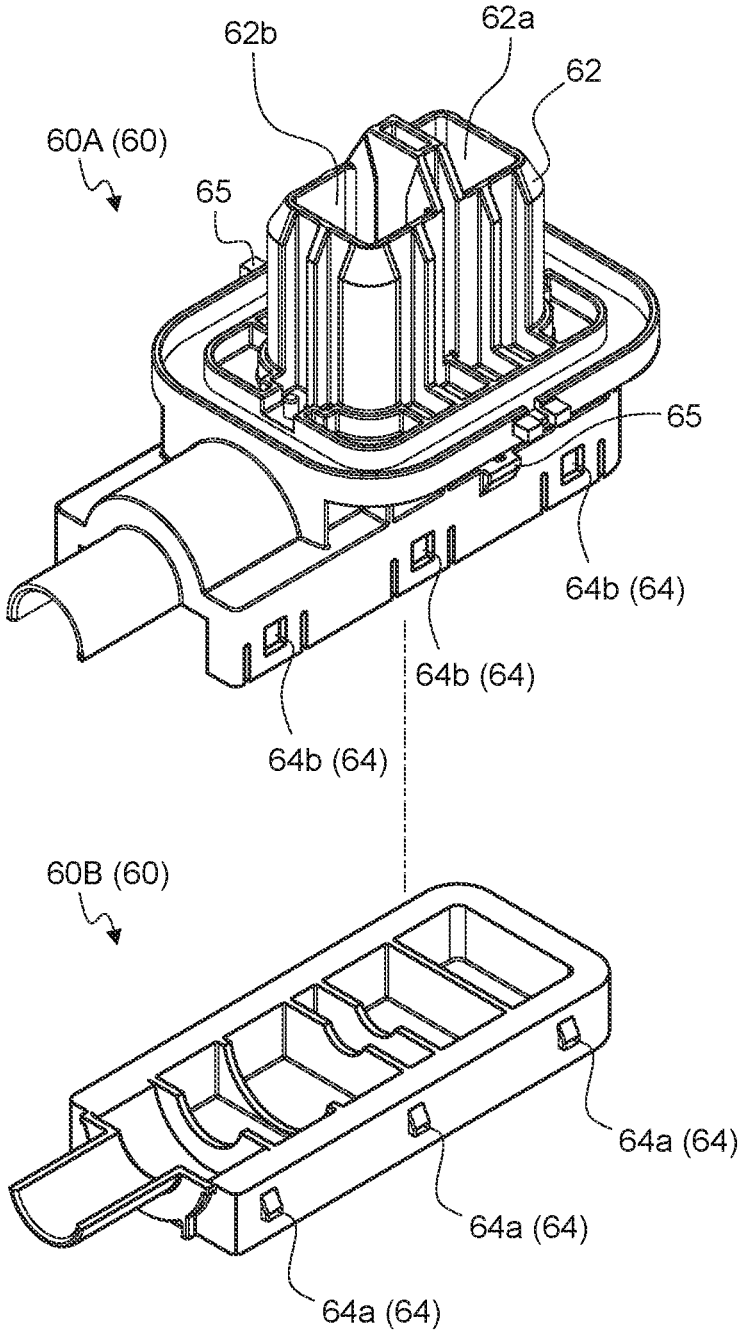
FIG. 14 is an exploded perspective view of the housing.

The housing 60 in the present example is a two-piece housing including a first housing member 60A and a second housing member 60B (FIG. 14). The first housing member 60A is fitted with the second housing member 60B in the connector insertion and disconnection direction. The base 61 of the housing 60 is formed by fitting the first housing member 60A with the second housing member 60B. The connector mating portion 62, which includes the first terminal storage 62*a* and the second terminal storage 62*b*, is formed in the first housing member 60A. The drawn hole 63 is configured by semicircular cutout portions provided in the first housing member 60A and the second housing member 60B that are fitted with each other.

A plurality of retaining structures 64 is provided between the first housing member 60A and the second housing member 60B to retain the fitted state. Each retaining structure 64 includes, for example, a protrusion 64*a* provided to one of the first housing member 60A and the second housing member 60B, and a locking part 64*b* provided on the other one thereof for locking the protrusion 64*a* in the connector insertion and disconnection direction so as not to release the fitted state between the first housing member 60A and the second housing member 60B. In the present example, the second housing member 60B is provided with locking pawls as protrusions 64*a* and the first housing member 60A is provided with throughholes as locking parts 64*b*.

The housing 60 includes the first sealing member 70 at a fitted portion between the first housing member 60A and the second housing member 60B. The first sealing member 70 is provided to increase liquid-tightness between the first housing member 60A and the second housing member 60B, and prevent liquid such as water from entering into the housing 60 through the fitted portion. The first sealing member 70 is made of a flexible synthetic resin material such as rubber or silicone.

Figure 15:
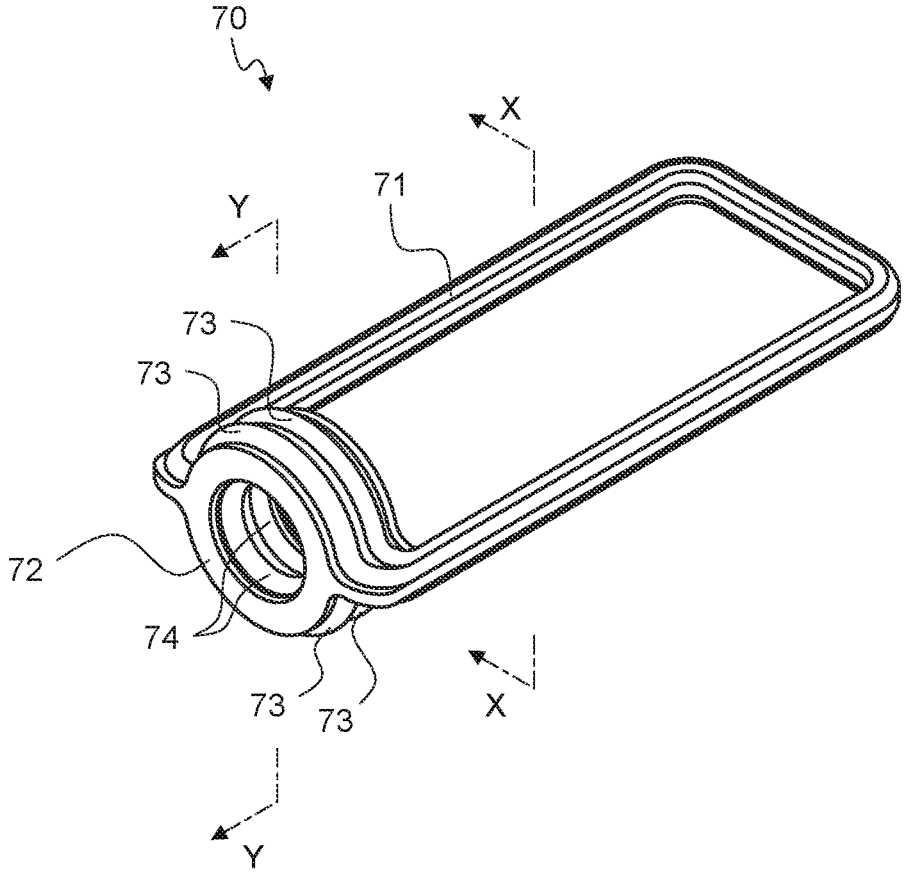
FIG. 15 is a perspective view of a first sealing member.
Figure 16:
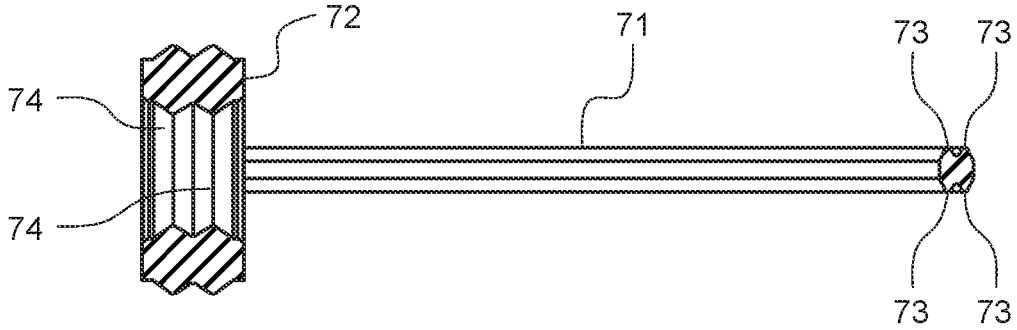
FIG. 16 is a sectional view taken along line X-X in FIG. 15.

In the present example, the fitted portion between the first housing member 60A and the second housing member 60B has a rectangular loop shape. The first sealing member 70 in the present example is formed in conformance with the rectangular-loop-shaped fitted portion, and includes a rectangular-loop-shaped sealing part 71 for tightly fitting the first housing member 60A with the second housing member 60B at the fitted portion (FIGS. 15 and 16).

In the housing 60, a better liquid tight seal is created at the drawn hole 63 from which the coaxial cable 100 is drawn. To achieve a better liquid tight seal at the drawn hole 63, a gap between the circumferential wall defining the drawn hole 63 and the outer circumferential surface of the coaxial cable 100 is filled. In the present example, the first sealing member 70 includes an annular sealing part 72 having an annular shape to fill the gap. The second insulator 104 at the cable end portion 100*a* of the coaxial cable 100 is coaxially inserted into the annular sealing part 72.

Figure 17:
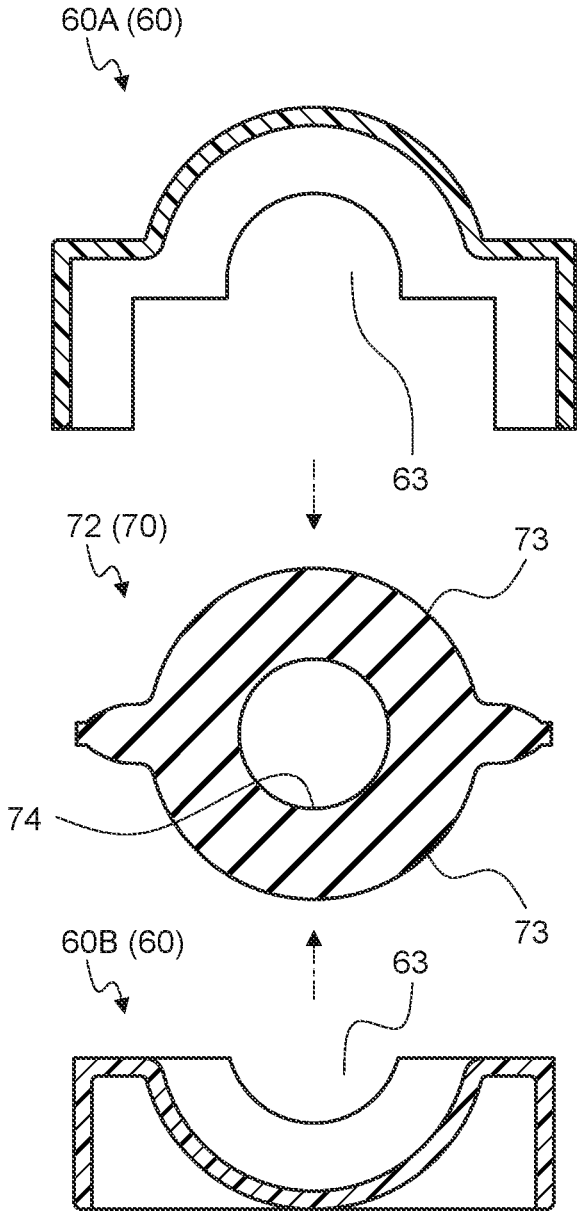
FIG. 17 is a sectional view taken along line Y-Y in FIG. 15, and illustrating the housing and the first sealing member before assembled.
Figure 18:
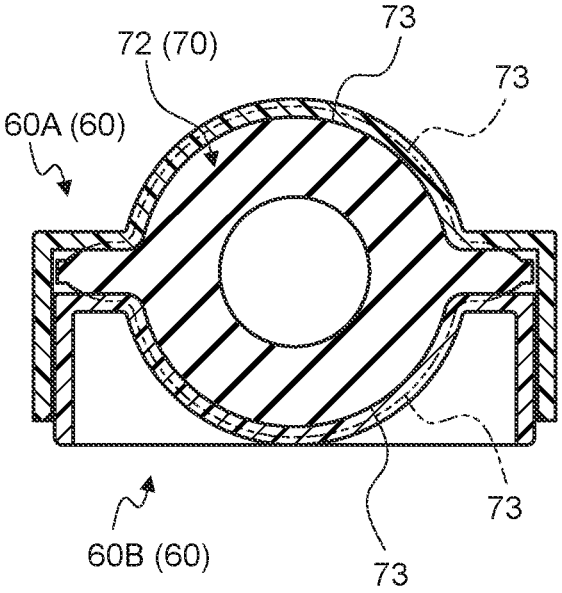
FIG. 18 is a sectional view taken along line Y-Y in FIG. 15, and illustrating the housing and the first sealing member after assembled.
Figure 19:
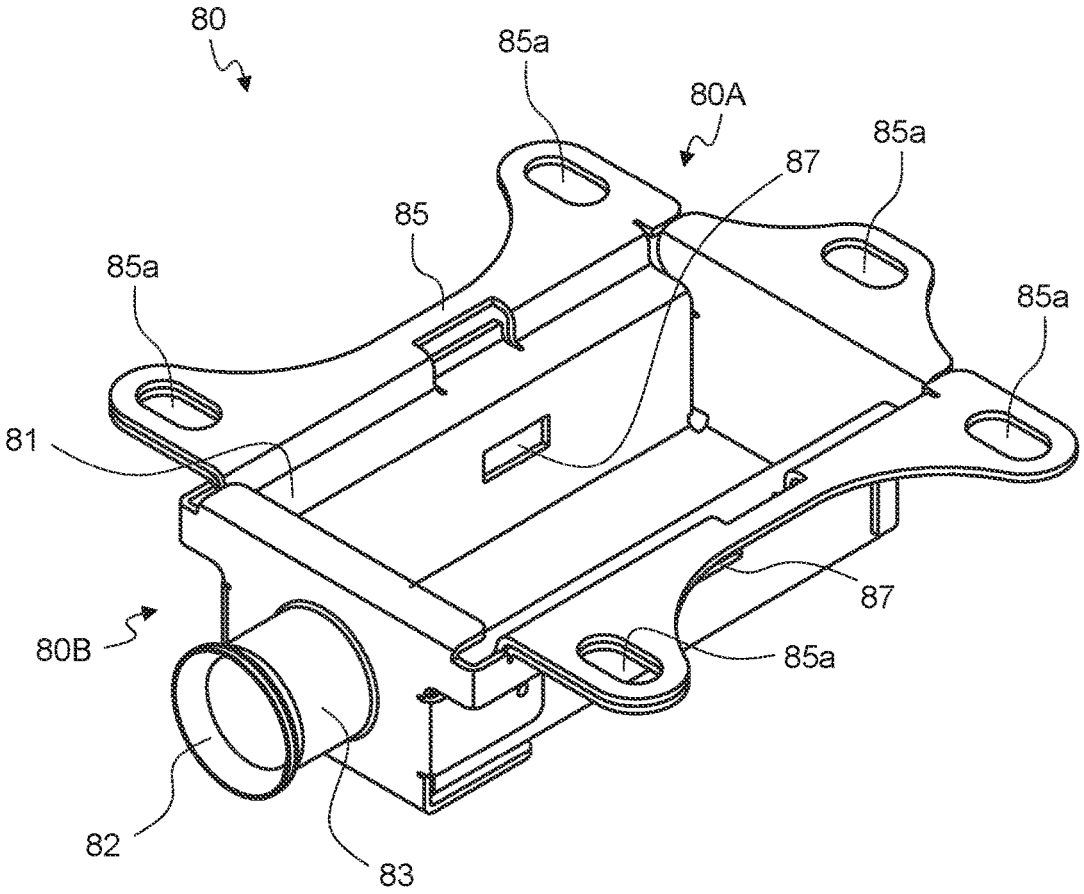
FIG. 19 is a perspective view of a shield shell.

Specifically, the first housing member 60A and the second housing member 60B each include a cut-out portion at one side of the rectangular-loop-shaped fitted portion, and the circumferential wall defining the drawn hole 63 is provided at the cut-out portions. The rectangular-loop-shaped sealing part 71 and the annular sealing part 72 of the first sealing member 70 are integrally formed with one side of the rectangular-loop-shaped sealing part 71 being replaced with the annular sealing part 72. The first sealing member 70 includes a plurality of lips 73 on a side close to the first housing member 60A and a side close to the second housing member 60B. The lips 73 extend along the three sides of the rectangular-loop-shaped sealing part 71 and the semicircular portion of the outer circumference of the annular sealing part 72 to form a loop. The lips 73 are formed such that the first housing member 60A and the second housing member 60B can compress the entire lips 73 including the lips 73 on the borders between the rectangular-loop-shaped sealing part 71 and the annular sealing part 72. The first housing member 60A, the second housing member 60B, and the lips 73 are configured to tightly fit each other even on the borders (FIGS. 17 and 18). The two-dot chain line in FIG. 18 indicates the outline of the lips 73 before the lips 73 are compressed by the first housing member 60A and the second housing member 60B.

In the first sealing member 70, a plurality of lips 74 are coaxially provided on the inner circumferential surface of the annular sealing part 72. The lips 74 are configured to tightly adhere to the outer circumferential surface of the second insulator 104 and configured to be compressed by the outer circumferential surface of the second insulator 104.

The connector mating portion 62 of the connector 10 is inserted into a through-hole in the floor panel FP from below to be fitted with the counterpart mating portion of the counterpart connector CN on the floor. This configuration leaves the base 61 of the housing 60 uncovered below the floor. The base 61 of the housing 60 is externally covered with the shield shell 80 to prevent external noises from entering thereto.

The shield shell 80 is made of a conductive material such as metal. The shield shell 80 has a rectangular parallelepiped shape with one open face as an opening 81 (FIG. 19), and the base 61 of the housing 60 is accommodated therein. The connector mating portion 62 protrudes from the opening 81 (FIG. 1).

The shield shell 80 has a drawn hole 82 from which the coaxial cable 100 drawn from the housing 60 is drawn to the outside, and has a tubular connecting portion 83 protruding from the circumference of the drawn hole 82 to the outside. The connecting portion 83 is a circular tube into which the second insulator 104 at the cable end portion 100*a* of the coaxial cable 100 is inserted. The outer circumferential surface of the connecting portion 83 is covered with the shield 105 at the cable end portion 100*a*. Furthermore, a tubular swaging member 84 is coaxially disposed radially outside of the shield 105 (FIG. 8). The swaging member 84 is a straight circular tube made of, for example, a metal material, and has flexibility so that the swaging member 84 can be deformed upon application of pressure from radially outside. The tubular swaging member 84 swages the shield 105 from the outer circumferential surface thereof onto the outer circumferential surface of the connecting portion 83 (FIG. 1), and the shield 105 is physically and electrically connected to the connecting portion 83.

The shield shell 80 has flange-shaped securing portions 85 at its edges around the opening 81. The securing portions 85 are fixed to the floor panel FP with their planar surfaces tightly adhering to the lower surface of the floor panel FP. For example, the floor panel FP includes male screw members B such as stud bolts protruding downward (FIGS. 1 and 2), and the securing portions 85 have through-holes 85*a* into which the respective male screw members B are inserted. The connector mating portion 62 of the connector 10 is fitted with the counterpart mating portion with the male screw members B in the floor panel FP being inserted into the corresponding through-holes 85*a* to allow the planar surfaces of the securing portions 85 to tightly adhere to the lower surface of the floor panel FP. Female screw members N are screwed onto the male screw members B, thereby securing the connector 10 to the lower surface of the floor panel FP.

Figure 20:
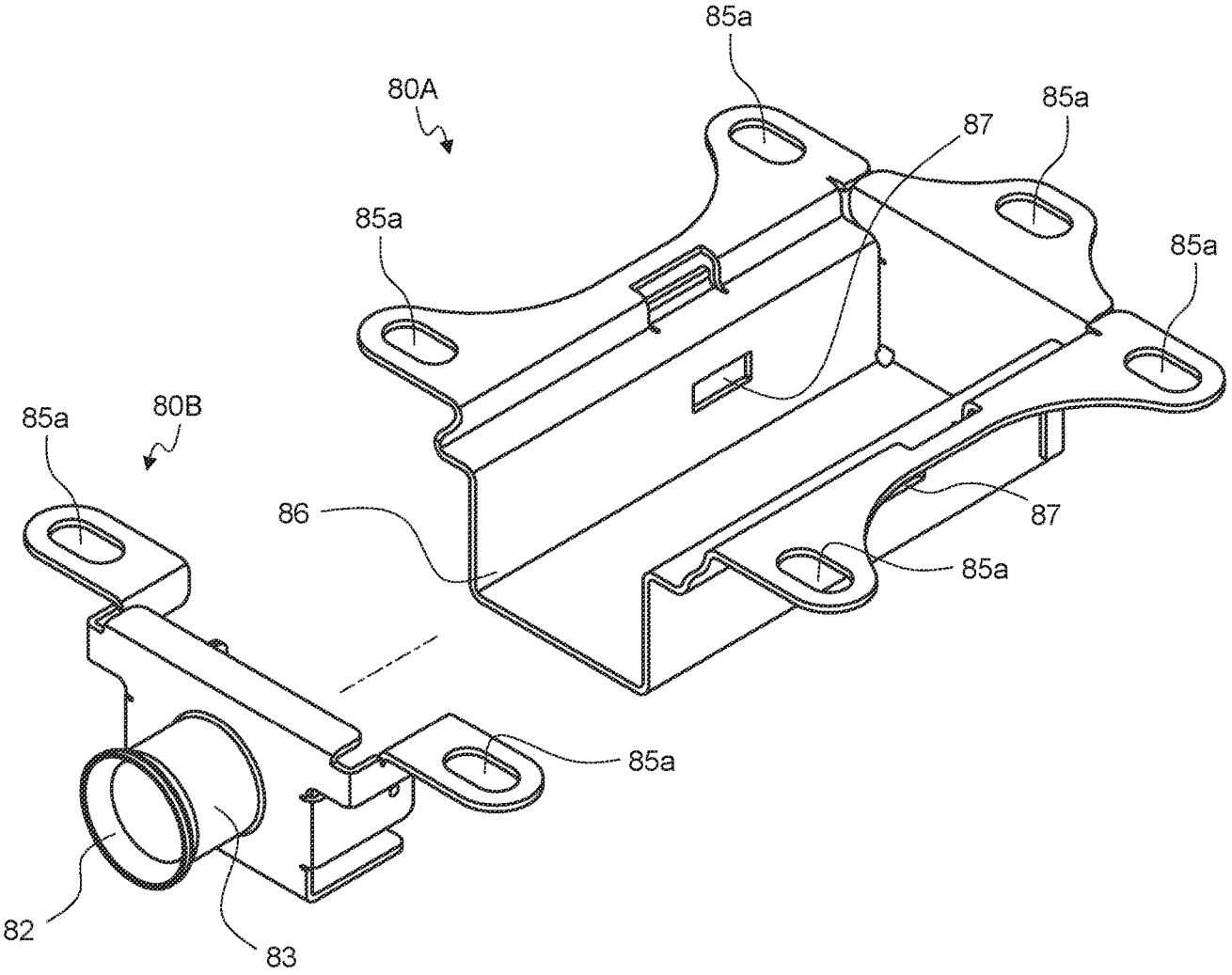
FIG. 20 is an exploded perspective view of the shield shell.

The shield shell 80 in the present example is a two-piece shield shell including a first shield shell member 80A and a second shield shell member 80B (FIG. 20). The first shield shell member 80A is, for example, a box-shaped main body including the opening 81 and the securing portions 85, and has another opening 86 in addition to the opening 81. The opening 86 is located at a position from which the coaxial cable 100 is drawn. The second shield shell member 80B is a plate-like member that closes the opening 86, and includes the drawn hole 82 and the connecting portion 83. The first shield shell member 80A and the second shield shell member 80B are integrated by, for example, welding or swaging.

The housing 60 is mounted to the shield shell 80 such that the housing 60 can move relative to the shield shell 80 in the axial direction of the cable end portion 100*a*, that is, in a direction in which the coaxial cable 100 is drawn from the drawn holes 63 and 82. The connector 10 includes a plurality of retaining structures for retaining the mount state of the housing 60 to the shield shell 80. Each retaining structure includes, for example, a protrusion 65 (FIGS. 13 and 14) provided on one of the housing 60 and the shield shell 80, and a locking part 87 (FIGS. 19 and 20) provided on the other one thereof for locking the protrusion 65 in the connector insertion and disconnection direction so as not to release the mount state of the housing 60 to the shield shell 80. In the present example, the first housing member 60A of the housing 60 is provided with locking pawls as protrusions 65 and the first shield shell member 80A of the shield shell 80 is provided with throughholes as locking parts 87. The protrusions 65 protrude in a direction perpendicular to the axial direction of the cable end portion 100*a* and to the connector insertion and disconnection direction. The locking parts 87 are disposed in accordance with the positions of the protrusions 65.

A gap is provided between the protrusion 65 and the locking part 87 as play in the axial direction of the cable end portion 100*a*. With this configuration, in the connector 10, the housing 60 can move relative to the shield shell 80 within the amount of the gap. If there is a relative misalignment within the range of tolerance between the connector mating portion 62 and the counterpart mating portion of the counterpart connector CN in the axial direction of the cable end portion 100*a* upon the mounting of the connector 10 to the floor panel FP, the gap allows the housing 60 to move relative to the shield shell 80, thereby enabling the connector mating portion 62 to be fitted with the counterpart mating portion. The amount of the gap between the protrusion 65 and the locking part 87 is set in accordance with the amount of relative misalignment within the range of tolerance.

It is desirable that the throughholes 85*a* of the shield shell 80 are elongated circular holes elongated in a direction perpendicular to the axial direction of the cable end portion 100*a* and to the connector insertion and disconnection direction, and that the throughholes 85*a* are provided with play relative to the male screw members B in this perpendicular direction. With this configuration, the connector 10 can move relative to the floor panel FP within the amount of play. If there is a relative misalignment within the range of tolerance between the connector mating portion 62 and the counterpart mating portion of the counterpart connector CN in a direction perpendicular to the axial direction of the cable end portion 100*a* and to the connector insertion and disconnection direction upon mounting of the connector 10 to the floor panel FP, the play allows the connector mating portion 62 to move relative to the counterpart mating portion mounted on the floor panel FP, thereby enabling the connector mating portion 62 to be fitted with the counterpart mating portion. The longitudinal length of the through-holes 85*a* is set in accordance with the amount of relative misalignment within the range of tolerance.

The connector 10 includes the second sealing member 90 to be located between the connector 10 and the floor panel FP after being secured (FIGS. 1 and 5). The second sealing member 90 is provided to increase liquid-tightness between the base 61 of the housing 60 and the lower surface of the floor panel FP, and to prevent liquid such as water from entering through the gap therebetween toward the connector mating portion 62. In the present example, a rectangular-loop-shaped end portion of the base 61 faces the lower surface of the floor panel FP. The second sealing member 90 in the present example has a rectangular loop shape in conformance with the rectangular loop shape of the end portion. The second sealing member 90 tightly adheres to the rectangular-loop-shaped end portion of the base 61 at one side and to the lower surface of the floor panel FP at the opposite other side. The second sealing member 90 is made of a synthetic resin material such as rubber or silicone.

The connector with a cable 1 is assembled in the following manner.

The cable end portion 100*a* of the coaxial cable 100 is inserted into the swaging member 84, the drawn hole 82 in the second shield shell member 80B, the annular sealing part 72 of the first sealing member 70, and the crimping member 40 in this order (FIG. 8). The swaging member 84, the second shield shell member 80B, the first sealing member 70, and the crimping member 40 are retracted at least to the exposed second insulator 104 at the cable end portion 100*a*. Subsequently, at the cable end portion 100*a*, the tubular member 50 is interposed between the first insulator 102 and the terminal connecting portion 103*b* of the outer conductor 103, and the conductor connecting portion 32 of the second terminal fitting 30 is interposed between the tubular member 50 and the terminal connecting portion 103*b*. The crimping member 40 is moved to the terminal connecting portion 103*b* covering the conductor connecting portion 32 and the tubular member 50. At the cable end portion 100*a*, the crimping member 40 is swaged in this state to crimp the linear conductors 103*a* of the terminal connecting portion 103*b* onto the outer circumferential surface of the conductor connecting portion 32, and the terminal connecting portion 101*a* of the center conductor 101 is joined to the conductor connecting portion 22 of the first terminal fitting 20 by ultrasonic welding. Subsequently, the first sealing member 70 is moved to a certain position at the cable end portion 100*a*.

Figure 21:
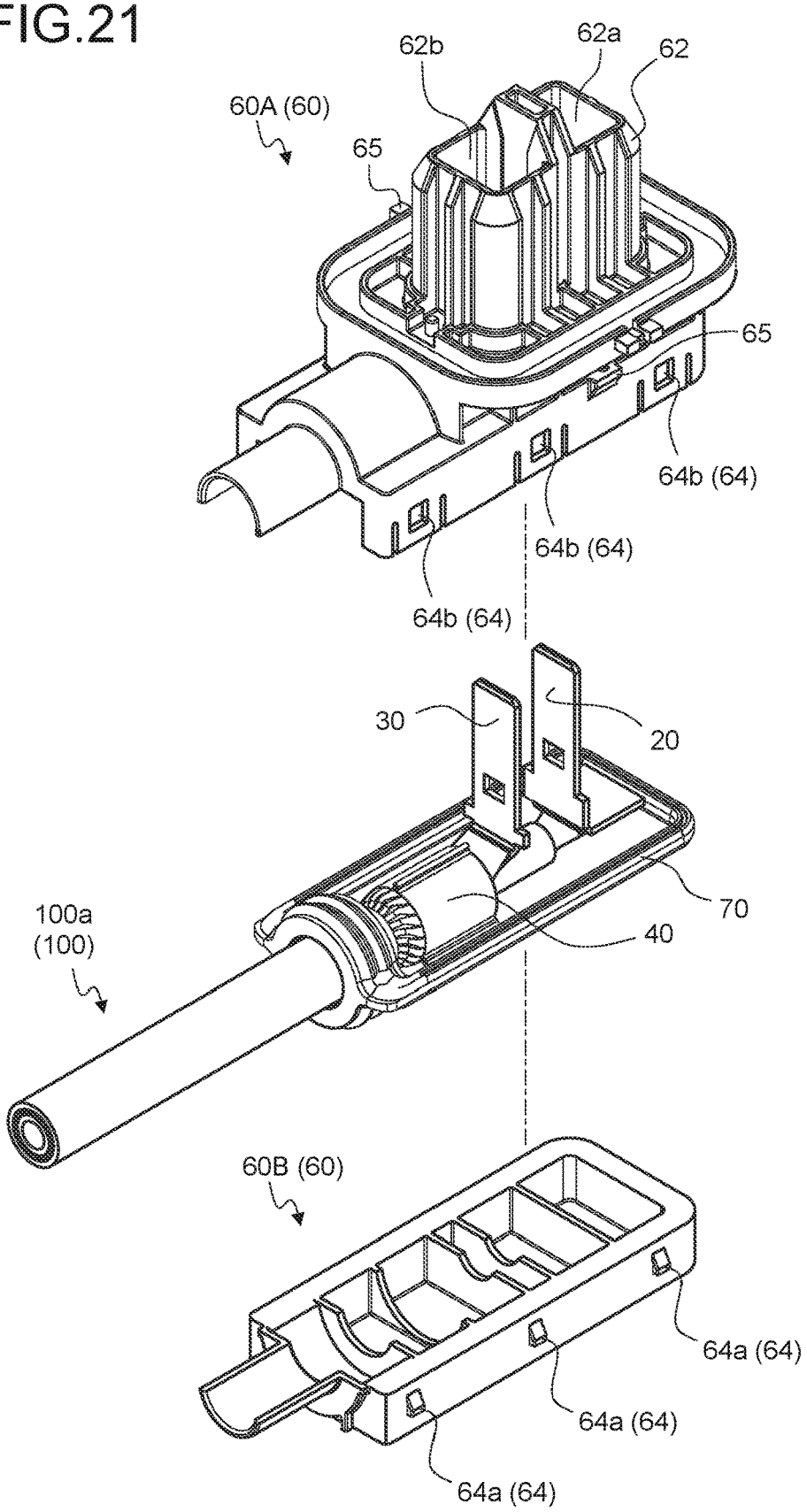
FIG. 21 is an exploded perspective view illustrating a method of mounting, to the housing, the coaxial cable to which parts such as the first terminal fitting are connected.

The cable end portion 100*a*, together with the first terminal fitting 20, the second terminal fitting 30, and the first sealing member 70 mounted thereto, are accommodated in the housing 60 (FIG. 21). The conductor connecting portions 22 and 32 are set in the second housing member 60B. In this process, the rectangular-loop-shaped sealing part 71 of the first sealing member 70 is fitted in the fitted portion of the second housing member 60B to the first housing member 60A, and the annular sealing part 72 of the first sealing member 70 is fitted in the semicircular cutout portion of the second housing member 60B. The terminal-to-terminal connecting portions 21 and 31 are accommodated in the first and the second terminal storages 62*a* and 62*b*, respectively, and the first housing member 60A is fitted with the second housing member 60B. In this process, the annular sealing part 72 of the first sealing member 70 is fitted in the semicircular cutout portion of the first housing member 60A. Subsequently, the second shield shell member 80B is fitted in the opening 86 of the first shield shell member 80A, and the base 61 of the housing 60 is accommodated in the first shield shell member 80A. The connecting portion 83 in the second shield shell member 80B is covered with the shield 105, and these are swaged by the swaging member 84.

The connector with a cable 1 is assembled in the manner above described.

As described above, the terminal crimping structure and the connector with a cable 1 according to the present embodiment include the tubular member 50 that is interposed between the conductor connecting portion 32 of the second terminal fitting 30 and the first insulator 102. The tubular member 50 ultimately receives force exerted upon application of pressure to the crimping member 40 by the crimping dies Mm, and prevents deformation of the conductor connecting portion 32. In the terminal crimping structure and the connector with a cable 1, this configuration allows the crimping member 40 to crush substantially evenly the linear conductors 103*a* of the terminal connecting portion 103*b* of the outer conductor 103 interposed between the conductor connecting portion 32 and the crimping member 40, and the linear conductors 103*a* can be crimped onto the outer circumferential surface of the conductor connecting portion 32. In this crimp process, the crushed portions 103$a_1$ are formed on the linear conductors 103*a* in the terminal crimping structure and the connector with a cable 1. The crushed portions 103$a_1$ are portions that abut each other such that circumferentially adjacent linear conductors 103*a* that are spaced apart before application of pressure by the crimping dies Mm are crushed by the application of pressure and that the gap therebetween is reduced. The crushed portions 103$a_1$ abutting each other are crushed until the crushed portions 103$a_1$ are axially extended by an amount that achieves the target crushed state. In the terminal crimping structure and the connector with a cable 1 according to the present embodiment, the oxide layer on the surface of the linear conductors 103*a* is broken at the respective crushed portions 103$a_1$, and a new surface having a desired exposed region is exposed. This configuration allows the crushed portions 103$a_1$ to adhere substantially evenly to the outer circumferential surface of the conductor connecting portion 32, thereby increasing crimping accuracy of the conductor connecting portion 32 onto the outer conductor 103.

The terminal crimping structure and the connector with a cable according to the present embodiment include a tubular member that is interposed between a conductor connecting portion of a terminal fitting (second terminal fitting) and an insulator (first insulator). The tubular member ultimately receives force exerted upon application of pressure to a crimping member by crimping dies, and prevents deformation of the conductor connecting portion. In the terminal crimping structure and the connector with a cable, this configuration allows the crimping member to crush substantially evenly linear conductors of a terminal connecting portion of an outer conductor interposed between the conductor connecting portion and the crimping member, and the linear conductors can be crimped onto the outer circumferential surface of the conductor connecting portion. In this crimp process, crushed portions are formed on the linear conductors in the terminal crimping structure and the connector with a cable. The crushed portions are portions that abut each other such that circumferentially adjacent linear conductors that are spaced apart before application of pressure by the crimping dies are crushed by the application of pressure and that the gap therebetween is reduced. The crushed portions abutting each other are crushed until the crushed portions are axially extended by an amount that achieves the target crushed state. In the terminal crimping structure and the connector with a cable according to the present embodiment, the oxide layer on the surface of the linear conductors is broken at the respective crushed portions, and a new surface having a desired exposed region is exposed. This configuration allows the crushed portions to adhere substantially evenly to the outer circumferential surface of the conductor connecting portion, thereby increasing crimping accuracy of the conductor connecting portion onto the outer conductor.

Although the invention has been described with respect to the specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal crimping structure comprising:

a coaxial cable that includes a pillar-shaped center conductor, a tubular insulator, and a tubular outer conductor coaxially disposed in this order from an axis, the outer conductor including a plurality of linear conductors made of aluminum or aluminum alloy, the linear conductors extending along an outer circumferential surface of the insulator in a direction that crosses a circumferential direction of the insulator to a cable axial direction, the linear conductors being arranged along the circumferential direction to virtually form the tubular outer conductor in a tubular shape;

a terminal fitting that includes a terminal-to-terminal connecting portion that is physically and electrically connected to a counterpart terminal, and a tubular conductor connecting portion coaxially interposed between the insulator and an exposed terminal connecting portion of the outer conductor at a cable end portion of the coaxial cable, the conductor connecting portion being physically and electrically connected to the terminal connecting portion;

a tubular crimping member that allows the terminal connecting portion to be coaxially interposed between the crimping member and the conductor connecting portion, the crimping member being deformed upon application of pressure applied radially inward to crimp the terminal connecting portion onto the conductor connecting portion; and a tubular member that is stronger and harder than the conductor connecting portion and is coaxially interposed between the conductor connecting portion and the insulator, wherein the linear conductors of the terminal connecting portion include crushed portions that abut each other such that circumferentially adjacent linear conductors that are spaced apart before the application of pressure are crushed and that a gap between the adjacent linear conductors is reduced by the crush under the pressure, the crushed portions abutting each other being crushed until the crushed portions are axially extended by an amount that achieves a target crushed state, the target crushed state being a state in which an oxide layer on the linear conductors is broken to obtain an exposed region of a new surface that is required for adhesion to the conductor connecting portion.

2. The terminal crimping structure according to claim 1, wherein the tubular member is configured to exert, on the conductor connecting portion, a reaction force equal to a force exerted radially inward from the conductor connecting portion upon the application of pressure.

3. The terminal crimping structure according to claim 1, wherein the tubular member is configured not to deform upon the application of pressure.

4. The terminal crimping structure according to claim 2, wherein the tubular member is configured not to deform upon the application of pressure.

5. A connector with a cable, comprising:

a coaxial cable that includes a pillar-shaped center conductor, a tubular insulator, and a tubular outer conductor coaxially disposed in this order from an axis, the outer conductor including a plurality of linear conductors made of aluminum or aluminum alloy, the linear conductors extending along an outer circumferential surface of the insulator in a direction that crosses a circumferential direction of the insulator to a cable axial direction, the linear conductors being arranged along the circumferential direction to virtually form the tubular outer conductor in a tubular shape; and a connector to which a cable end portion of the coaxial cable is connected, wherein the connector includes a terminal fitting that includes a terminal-to-terminal connecting portion that is physically and electrically connected to a counterpart terminal of a counterpart connector, and a tubular conductor connecting portion coaxially interposed between the insulator and an exposed terminal connecting portion of the outer conductor at the cable end portion, the conductor connecting portion being physically and electrically connected to the terminal connecting portion, a tubular crimping member that allows the terminal connecting portion to be coaxially interposed between the crimping member and the conductor connecting portion, the crimping member being deformed upon application of pressure applied radially inward to crimp the terminal connecting portion onto the conductor connecting portion, and a tubular member that is stronger and harder than the conductor connecting portion and is coaxially interposed between the conductor connecting portion and the insulator, the linear conductors of the terminal connecting portion include crushed portions that abut each other such that circumferentially adjacent linear conductors that are spaced apart before the application of pressure are crushed and that a gap between the adjacent linear conductors are reduced by the crush under the pressure, the crushed portions abutting each other being crushed until the crushed portions are axially extended by an amount that achieves a target crushed state, the target crushed state being a state in which an oxide layer on the linear conductors is broken to obtain an exposed region of a new surface that is required for adhesion to the conductor connecting portion.

6. The connector with a cable according to claim 5, wherein the coaxial cable includes the center conductor, a first insulator as the insulator, the outer conductor, a tubular second insulator different from the insulator, a tubular shield, and a tubular protective outer sheath coaxially disposed in this order from the axis, and the connector includes a first terminal fitting different from the terminal fitting, the first terminal fitting being physically and electrically connected to the center conductor, a second terminal fitting as the terminal fitting, a housing that stores therein the first terminal fitting and the second terminal fitting, and a shield shell that externally covers the housing and that is electrically connected to the shield.

* * * * *